US009719278B2

(12) United States Patent
Taylor et al.

(10) Patent No.: US 9,719,278 B2
(45) Date of Patent: Aug. 1, 2017

(54) LOCK SYSTEM

(71) Applicant: SURELOCK McGILL LIMITED, Wokingham (GB)

(72) Inventors: Liam Taylor, Oldham (GB); Stuart Kenneth Parker, Portsmouth (GB)

(73) Assignee: Surelock McGill Limited, Wokingham, Berkshire (GB)

( * ) Notice: Subject to any disclaimer, the term of this patent is extended or adjusted under 35 U.S.C. 154(b) by 360 days.

(21) Appl. No.: 14/286,964

(22) Filed: May 23, 2014

(65) Prior Publication Data

US 2015/0033808 A1 Feb. 5, 2015

(30) Foreign Application Priority Data

Aug. 2, 2013 (GB) ..... 1313894.6

(51) Int. Cl.
*E05C 1/00* (2006.01)
*E05B 47/00* (2006.01)
(Continued)

(52) U.S. Cl.
CPC ..... *E05C 1/004* (2013.01); *E05B 47/0001* (2013.01); *E05B 47/0603* (2013.01);
(Continued)

(58) Field of Classification Search
CPC .. E05B 32/08; E05B 47/0001; E05B 47/0603; E05B 63/0065; E05B 47/0004;
(Continued)

(56) References Cited

U.S. PATENT DOCUMENTS 1,511,956 A * 10/1924 Flagg ..... E05B 63/244 292/142
2,672,745 A * 3/1954 Marchetti ..... E05B 63/242 292/177
(Continued)

FOREIGN PATENT DOCUMENTS

CA 2 332 682 A1 7/2001
GB 1 452 667 A 10/1976
(Continued)

OTHER PUBLICATIONS

Patents Act 1977: Search Report under Section 17 for corresponding UK Patent Application No. GB1313894.6, 2 pages, (Feb. 18, 2014).

*Primary Examiner* — Suzanne Barrett
(74) *Attorney, Agent, or Firm* — Blakely, Sokoloff, Taylor & Zafman LLP

(57) ABSTRACT

A lock system for controlling access, for example to a room or building, is disclosed. The lock system comprises a bolt module in which control of the bolt can be configured differently on the two sides of a leaf or door. Control of the bolt module may be provided by various locking modules, which are also disclosed herein. The bolt module is reversible for left handed or right handed operation. In one embodiment the bolt module comprises: a bolt moveable between a thrown position and a retracted position; and a first rotor assembly capable of accepting a drive element, the first rotor assembly arranged to drive the bolt. The bolt module may also comprise a second rotor assembly. The bolt module may comprise an anti-thrust member obstructing driving back of the bolt under action of an external force on the bolt. The bolt module may comprise a lockable cover.

31 Claims, 24 Drawing Sheets

(51) Int. Cl.
*E05B 47/06* (2006.01)
*E05B 63/00* (2006.01)
*E05B 63/04* (2006.01)

(52) U.S. Cl.
CPC ..... *E05B 63/0065* (2013.01); *E05B 47/0004* (2013.01); *E05B 63/0069* (2013.01); *E05B 63/04* (2013.01); *E05B 2047/0067* (2013.01); *Y10T 16/5335* (2015.01); *Y10T 70/5199* (2015.04); *Y10T 292/1018* (2015.04)

(58) Field of Classification Search
CPC ..... E05B 63/0069; E05B 63/04; E05B 2047/0067; E05C 1/004; Y10T 16/5335; Y10T 70/5199; Y10T 292/1018
USPC ..... 70/279.1
See application file for complete search history.

(56) References Cited

U.S. PATENT DOCUMENTS 3,175,376 A * 3/1965 Cantwell ..... E05B 17/042 292/140
3,245,238 A * 4/1966 Young ..... E05B 63/0017 292/142
4,058,333 A * 11/1977 Roe ..... E05B 63/06 292/142
4,163,375 A * 8/1979 Fujitaki ..... E05B 63/0017 292/142
4,248,068 A * 2/1981 Esser ..... E05B 63/0017 292/142
4,583,382 A 4/1986 Hull
4,633,688 A * 1/1987 Beudat ..... E05B 47/0012 292/142
5,199,288 A * 4/1993 Merilainen ..... E05B 47/0012 292/144
5,214,946 A * 6/1993 Antonello ..... E05B 63/0017 292/144
5,280,881 A * 1/1994 Karmin ..... E05B 47/0012 292/142
5,480,198 A * 1/1996 Wydler ..... E05B 47/0012 292/142
5,482,334 A * 1/1996 Hotzl ..... E05B 53/00 292/142
5,609,051 A 3/1997 Donaldson
5,862,693 A * 1/1999 Myers ..... E05B 47/0002 292/144
5,865,479 A * 2/1999 Viney ..... E05B 47/0603 292/39
6,658,905 B1 * 12/2003 Hsieh ..... E05B 47/0012 70/107
2004/0239121 A1 * 12/2004 Morris ..... E05B 13/004 292/39
2007/0204662 A1 * 9/2007 Pullmann ..... E05B 15/101 70/277
2008/0264121 A1 10/2008 Marko
2015/0225983 A1 * 8/2015 Alzingre ..... E05B 47/0005 292/143

FOREIGN PATENT DOCUMENTS

GB 2 289 084 A 11/1995
WO WO 03/091518 A1 11/2003
WO WO 2011/160188 A1 12/2011

* cited by examiner

LOCK SYSTEM

TECHNICAL FIELD

The present invention relates to a lock system for controlling access, for example to a room or building. More particularly the invention relates to a lock system comprising a bolt module in which control of the bolt can be configured differently on the two sides of a leaf or door. Control of the bolt module may be provided by various locking modules. The bolt module is preferably reversible for left handed or right handed operation.

BACKGROUND

Doors fitted to emergency exits commonly have a push pad or panic bar fitted on the inside of the door. The push pad or panic bar provides one-push access to the outside and is especially useful for fast, unhindered access to the outside in an emergency. Similar to panic bars are touch bars. Panic bars generally require a downward rotational push to operate and retract one or more bolts of the door. The bar may extend across the full width of the door. A push pad has a similar action but, instead of comprising a bar, has a pad for operation which is usually located at the opening side of the door. Touch bars differ from panic bars in that to operate the direction of action is horizontally towards the door.

Push pads, panic bars and touch bars can operate on single or multi point bolting systems to secure the door. An example of a multi-point bolting system is found in GB 2289084 which describes a latching locking mechanism. The bolting system comprises three bolts respectively operating in up, down and sideways directions. The system is arranged to prevent an external force on the end of one of the bolts pushing the bolt to move it to the retracted position. This is achieved by a latch arrangement in the bolting system to hold the bolts in an engaged or thrown position. An operating member such as a push pad, panic bar or touch bar, is provided to release the latch and retract the bolts. The bolts are operated by racks provided on the bolts and rotating gears arranged to transfer motion between the bolts. To retract the bolts from the inside side of the door an operating member is actuated to turn a first, latch gear wheel to a first position to move the latch. In this position continued turning of the operating member turns a second gear wheel which acts on the bolts to retract them.

The latching bolting mechanism of GB 2289084 in combination with, for example a push pad provides one-push access to the outside of a building form the inside which is particularly advantageous in an emergency. It is often also desirable to be able to enter the building through the same door from the outside. An operating member, which in this case could be a handle, could also be provided on the outside of the door. To provide locked access from the outside, GB 2289084 also describes a lock mechanism which acts directly on one of the bolts so as to provide security. The lock mechanism is provided to limit access from the outside to the inside, and is released when operated with a matching key. Modifications to the bolt are required such that the bolts can continue to be released from the inside even when the lock mechanism acts on the bolt.

The arrangement of GB 2289084 is particularly suited to multi-point bolting systems. It is desirable to provide a locking system which can be used for single bolt systems.

It is also desirable to provide a bolting system that can be inverted for use on left-hand and right-hand opening doors while being able to select the direction of operation of the operating member. It is desirable to provide this reversibility with minimum disassembly.

It is further desirable to provide a greater range of access functionality in combination with the emergency egress.

SUMMARY OF THE INVENTION

The present invention provides a lock system for securing a leaf having an inside and an outside, the lock system comprising: a bolt module including: a bolt moveable between a thrown position to secure the leaf and a retracted position; and first and second rotor assemblies disposed on opposing sides of the bolt, each rotor assembly being capable of accepting both inside and outside drive elements each for driving the bolt between the thrown and retracted positions from the respective side, and first and second locking modules, each locking module being operable to lock at least a part of the respective first or second rotor assembly such that the locking module prevents at least the outside drive element from driving the bolt. The advantage of this lock system is the flexibility to lock operation of the bolt in the thrown position on the one side of the leaf. By the term "each rotor assembly being capable of accepting inside and outside drive elements" we mean that the rotor assemblies themselves are adapted to receive drive elements. All possible drive combinations will be unlikely to be used in a given implementation, and may be blanked off by the housing or by blanking plates for the housing.

At least another part of the respective first or second rotor assembly may be configured so as not to be lockable by the first and/or second locking module so as to allow the inside drive element to drive the bolt. For exit in an emergency the inside rotors are not locked by the locking modules.

The rotor assemblies may be arranged such that to retract the bolt, a drive element accepted by the first rotor assembly is rotated in an opposite direction to a drive element accepted by the second rotor assembly. This provides reversible operation for left hand and right hand opening doors. By reversible we mean that the lock system may be mounted on doors opening from either side and the drive direction of the drive element can be selected or reversed. Opening may be taken to mean opening towards the user or out from the building.

The bolt module may further comprise an anti-thrust assembly arranged to block driving back of the bolt from the thrown position by an external force on the bolt, the anti-thrust assembly arranged to be released for retraction of the bolt upon driving by a rotor assembly. The anti-thrust assembly prevents forced reverse driving. In conventional devices that do not have anti-thrust it is possible to push the bolt all the way in and open the leaf. Here the anti-thrust assembly prevents this.

Each locking module may be disposed on an opposite side of the corresponding rotor assembly from the bolt.

At least one rotor assembly may comprise an inside rotor capable of accepting the inside drive element and an outside rotor capable of accepting the outside drive element, the inside rotor and outside rotor arranged for rotation about a common axis and having lost-motion there between. The outside rotor may be arranged to be locked by the first or second locking module, and the inside rotor may be arranged to retract the bolt when driven by the inside drive element independently of whether the outside rotor is locked. The lost motion permits this independent inside driving.

The inside rotor may be arranged such that drive of the inside rotor by the inside drive element drives the outside rotor and together the inside rotor and outside rotor retract the bolt.

The bolt may be arranged to be driven by the rotor assemblies by action of a slider on the bolt, the slider being arranged to transmit motion of a rotor assembly to the bolt and including lost motion between the bolt and slider such that the rotor assembly is not driven when an external force is applied on the bolt.

The slider may be an outside slider arranged to be operated on by at least one outside rotor. The bolt module may further comprise an inside slider arranged to transmit motion of an inside rotor to retract the bolt including lost motion between the bolt and inside slider such that the inside rotor is not driven when an external force is applied on the bolt. The sliders may be arranged to have lost motion with the bolt such that on driving the bolt by an inside rotor, the outside slider and outside rotors are not moved.

The outside rotor may have a stop element such as a stopping shoulder arranged to be operated on by the locking module to stop rotation of the outside rotor when the locking module locks said at least a part of the respective rotor assembly.

The slider may transmit rotation from one rotor assembly to the other such when the first rotor assembly is rotated to retract the bolt the direction of rotation is opposite to the direction of rotation of the second rotor assembly for retracting the bolt. This arrangement provides reversible drive.

The bolt module may further comprise an anti-thrust assembly arranged to block driving back of the bolt from the thrown position by an external force on the bolt, the anti-thrust assembly arranged to be released for retraction of the bolt upon driving by a rotor assembly, and the anti-thrust member is biased to the drive the bolt to the thrown position.

The anti-thrust member may operate on an outside rotor. The lock system may further comprise a bias member operating on an inside rotor to bias the bolt to the thrown position. The bias member may provide anti-thrust to prevent driving back of the bolt when an external force is applied on the bolt.

The bolt module may further comprise a bolt restraint latch and trigger, the bolt restraint latch configured to operate on the bolt and engage with the bolt when the bolt is moved to the retracted position so as to restrain the bolt in that position, and the trigger extending from the bolt module and arranged such that on striking of the trigger the trigger pushes against the bolt restraint latch releasing the bolt.

The amount the trigger extends from the bolt module may be adjustable.

The trigger may comprise a trigger finger and a latch pusher, the latch pusher coupled to the trigger finger by a threaded rod screwed into a mating thread in the trigger finger, the distance between the latch pusher and trigger finger may be set by turning the screw so as to adjust amount the trigger extends from the bolt module.

The rotors may be gears and the sliders may include racks on one or two sides to be driven by the rotors. The stopping shoulder may be arranged adjacent to an aperture in a housing for the bolt module. The stopping shoulder may be the thickness of the inside rotor and outside rotor together.

The bolt module may comprise a housing formed of a first housing portion and a second housing portion, at least the second housing portion having holes or fixings for fixing to a leaf, wherein the first housing portion houses the first and second rotor assemblies, the second housing portion houses the bolt, the second housing portion having one or more guides to constrain the direction of movement of the bolt to movement between thrown and retracted positions, and the first and second housing portions may be of different materials.

The guides of the second housing may support the bolt to retain the thrown bolt in the absence of the first housing portion, when fitted to a leaf. The guides may constrain movement of the bolt preventing transverse movement of the bolt.

The second housing portion may have an aperture through which the bolt extends when securing the leaf.

The material of the second housing portion may have a higher melting point than the material of the first housing portion. The material of the second housing portion may be stainless steel, steel or a steel-based material. The material of the first housing portion may be aluminium, or an aluminium-based material.

The present invention further provides a bolt module comprising: a bolt moveable between a thrown position and a retracted position for securing a leaf; and first and second rotor assemblies disposed on opposing sides of the bolt, each rotor assembly being capable of accepting drive elements each for driving the bolt between the thrown and retracted positions, wherein at least one rotor assembly comprises an inside rotor capable of accepting an inside drive element and an outside rotor capable of accepting an outside drive element, the inside rotor and outside rotor arranged for driving the bolt, the outside rotor adapted to be capable of being locked, the inside rotor and outside rotor arranged for rotation about a common axis and having lost-motion there between such that the inside rotor is arranged to retract the bolt when driven by the inside drive element independently of whether the outside rotor is locked.

The inside rotor may be arranged such that drive of the inside rotor by the inside drive element drives the outside rotor and together the inside rotor and outside rotor retract the bolt.

The present invention provides a bolt module comprising a bolt arranged to be driven between a thrown and retracted position, the bolt module may further comprise a bolt restraint latch and trigger, the bolt restraint latch may be configured to operate on the bolt and engage with the bolt when the bolt is moved to the retracted position so as to restrain the bolt in that position, and the trigger extending from the bolt module and arranged such that on striking of the trigger the trigger pushes against the bolt restraint latch releasing the bolt. Preferably the amount the trigger extends from the bolt module may be adjustable. This provides the advantage of being able to set the trigger for the size of gap between the door and door jamb. The trigger may comprise a trigger finger and a latch pusher, the latch pusher coupled to the trigger finger by a threaded rod screwed into a mating thread in the trigger finger, the distance between the latch pusher and trigger finger may be set by turning the screw so as to adjust amount the trigger extends from the bolt module.

The present invention provides a bolt module comprising: a bolt moveable between a thrown position and a retracted position; an anti-thrust member moveable between a position obstructing driving back of the bolt under action of an external force on the bolt and a release position in which the bolt can be retracted, and a first rotor assembly capable of accepting a drive element, the first rotor assembly arranged to drive the bolt and to move the anti-thrust member to the release position. Obstruction of driving back of the bolt is preferably obstruction of the path of the bolt if driven back.

The bolt and first rotor assembly may be arranged such that there is lost motion there between when an external force is applied on the bolt to drive back the bolt, such that the rotor assembly is not driven by the action of the external force.

The bolt module may further comprise a slider arranged to transmit motion from the first rotor assembly to the bolt and including said lost motion between the bolt and slider such that the first rotor assembly is not driven when an external force is applied on the bolt.

The anti-thrust member may be biased to drive the first rotor assembly to throw the bolt.

The bolt module may further comprise a second rotor assembly, the first and second rotor assemblies disposed on opposing sides of the bolt, each rotor assembly being capable of accepting drive elements each for driving the bolt between the thrown and retracted positions, wherein the rotor assemblies are arranged such that to retract the bolt, a drive element accepted by the first rotor assembly is rotated in an opposite direction to a drive element accepted by the second rotor assembly.

The slider may be arranged between first and second rotor assemblies for transmitting drive between said rotor assemblies.

The bolt module may be adapted for securing a leaf having an inside and an outside, wherein at least one of the first and second rotor assemblies is capable of accepting both inside and outside drive elements each for driving the bolt between thrown and retracted positions from the respective side, and the bolt module arranged to receive a locking member from a locking module, said rotor assembly arranged such that at least part of said rotor assembly is for locking by the locking member so as to prevent the inside drive element from driving the bolt.

The bias provided by the anti-thrust member to drive the first rotor assembly to throw the bolt may operate to bias the outside drive element.

The bolt module may further comprising a bias member arranged to provide bias to drive the inside drive element to throw the bolt. The bias member may provide drive through the second rotor assembly.

The bolt module may comprise a housing formed of a first housing portion and a second housing portion, at least the second housing portion having mounting holes or fixings for fixing to a leaf, wherein the first housing portion may house at least the first rotor assembly, the second housing portion may house the bolt, the second housing portion may have one or more guides to constrain the direction of movement of the bolt to movement between thrown and retracted positions, and the first and second housing portions may be of different materials.

The present invention further provides a single sided lock system and bolt module, in which the lock system is for securing a leaf having an inside and an outside, the lock system comprising: a bolt module including: a bolt moveable between a thrown position and a retracted position; and a rotor assembly for driving the bolt, the rotor assembly capable of accepting both inside and outside drive elements each for driving the bolt between thrown and retracted positions from the respective side, and a locking module operable to lock at least a part of the rotor assembly such that the locking module prevents at least the outside drive element from driving the bolt.

The rotor assembly may comprises a rotor or cam, the locking module having a locking member arranged such that when in the locked position it interferes with the rotor preventing the outside drive element from driving the bolt.

The rotor or cam of the rotor assembly may comprise a stop element such as a stopping shoulder, the stop element arranged such that rotation of the rotor is blocked by the locking member of the locking module thereby preventing the outside drive element from driving the bolt.

The rotor assembly may comprise inside and outside rotors respectively capable of accepting inside and outside drive elements each for driving the bolt from the respective side, the inside and outside rotor elements having lost-motion there between such that the inside rotor can be driven to retract the bolt when the outside rotor is locked by the locking module. By the term "capable of accepting inside and outside drive elements" we mean that the rotor assemblies themselves are adapted to receive drive elements. All possible drive combinations will be unlikely to be used in a given implementation, and may be blanked off by the housing or by blanking plates for the housing.

The present invention further provides a lock system for securing a leaf having an inside and an outside, the lock system comprising a bolt module having a housing and a cover, the cover adapted to conceal fixings for fixing the bolt module to the leaf and/or fixings for a drive element for driving a bolt of the bolt module, the cover having a locking element configured for movement between locked and unlocked positions upon receipt of a matching key, the housing having an aperture for receiving the locking element of the cover when in an unlocked position, wherein when the locking element is in the locked position the housing prevents removal of the cover.

The locking element may block retraction of the bolt when the cover is fitted to the housing and the locking element is in the unlocked position.

The lock system may further comprise a locking module for locking movement of at least part of the bolt module, the locking module having a retention member extending to the bolt module and trapped by the cover preventing access inside the locking module when the cover is locked. By the term "trapped" we mean that the retention member is covered by the cover, for example, so as to prevent lifting the locking module away from the bolt module.

The lock system may further comprise a locking module for locking movement of at least part of the bolt module.

The lock system may further comprise a locking module for locking movement of at least part of the bolt module, the locking module comprising a locking member arranged to be driven between a thrown position and a retracted position, the locking member of the locking module locking the at least part of the bolt module when the locking member is in the thrown position, and the cover having a receiver for receiving the locking member when the locking member is in the thrown position thereby preventing removal of the cover. The receiver may be an aperture formed in an extension arranged normal to the plane of the cover. The extension may wrap around the side of the bolt module.

The locking element may comprise a key cylinder and rotatable cam arranged to be driven between locked and unlocked positions by a matching key.

The present invention further provides a leaf comprising the lock system above, wherein the lock system is mounted on the inside face of the leaf.

The bolt module may comprise: a bolt moveable between a thrown position and a retracted position; a bolt drive assembly for accepting a drive element for driving the bolt between thrown and retracted positions; and the housing may be formed of a first housing portion and a second housing portion, at least the second housing portion having said fixings for fixing to a leaf, wherein the first housing portion houses at least part of the bolt drive assembly and the second housing portion houses the bolt, the second housing portion having one or more guides to constrain the direction of movement of the bolt to movement between thrown and retracted positions, and the first and second housing portions may be of different materials.

The present invention further provides reinforcement or reinforcement assembly for a door or leaf, comprising: a first plate for fixing to a face of the door or leaf, the first plate having studs; a plurality of pillars, each pillar adapted to receive a stud at one end; a second plate for fixing to an opposing face of the door or leaf, and being supported by second ends of the respective pillars, wherein the distance between the first plate and second plate is adjustable to fit the thickness of the door or leaf by adjusting the extent to which each pillar receives a respective stud. The pillars and studs are fitted through holes in the door or leaf. The reinforcement is particularly suitable for use at the point of mounting a lock system to the door. Preferably the studs are integral to the first plate.

Each may be a threaded stud and the respective pillar may receive the stud in a threaded hole there through, the adjustment of the extent that the stud is received in the pillar is by rotation of the pillar with respect to the stud. Other alternatives are possible such as the pillar being received in the stud, and/or the pillar and stud being able to slide with respect to each and for example be locked at relative positions by a pin inserted through a hole in the stud and pillar. Advantageously, the threaded pillar and stud approach provides continuous adjustment over a range.

The reinforcement may further comprise a locking device for locking the extent to which each pillar receives the respective stud. The locking device may be a lock screw adapted for insertion into the second end of the pillar for locking the extent the stud is received in the pillar.

The reinforcement may further comprise fixings for fixing the second plate to the pillars.

The first and/or second plates may further comprise holes for mounting a lock system or bolt module, to the plate, door or leaf.

The reinforcement may further comprising a cover plate for receiving through an aperture at least one drive element for driving the lock system, the driving element fixing to at least one of the first plate, second plate, door or leaf, and retaining the cover plate there between.

The present invention provides a locking module having a locking member moveable between a thrown position and a retracted position, the locking module comprising: a drive bar movable about a pivot located between first and second ends of the drive bar, towards the first end of the drive bar is coupled an electromechanical drive device, towards the second end the drive bar is coupled to the locking member; and a tang adapted to be driven by a key cylinder, the tang arranged to drive the drive bar upon rotation of the key cylinder, wherein movement of the driver bar, by the electromechanical drive device or the tang, rotates the second end of the drive bar about the pivot to retract the bolt. The action of retraction of the locking member and release of the anti-thrust member may be by a single operation of movement of the drive bar.

The tang may optionally be arranged to drive the drive bar towards its second end.

The coupling between the drive bar and locking member may be by a pin on the drive bar movable in a slot of the locking member, or vice versa.

The locking member may further comprise an anti-thrust lever and an anti-thrust block arranged such that upon application of an external force on the end of the locking member to drive the locking member, movement of the anti-thrust lever is blocked by the anti-thrust block preventing movement of the locking member, and wherein upon drive of the drive bar the anti-thrust lever is rotated as the pin moves in the slot, the rotation of the anti-thrust lever releasing the locking member for retraction.

The present invention provides a locking module having the features above, plus the following features. Alternatively the locking module may be different to the locking member above but may comprise the following features. The locking module may comprise a locking member moveable between a thrown position and a retracted position, the locking member arranged to be driven upon receipt of a matching key, code or signal, the locking module further comprising at least one of: a lock-off assembly arranged such that upon activation prevents throwing of the locking member from the retracted position to the thrown position; a lock-on assembly arranged such that upon activation prevents retraction of the locking member from the thrown position to the retracted position; and a lock-puller assembly arranged to drive the locking member from the retracted position to the thrown position.

The lock-off assembly may comprise a pinion gear engaging with a rack of a crossbar, the crossbar arranged for engagement or blocking of the locking member to prevent throwing of the locking member from the retracted position to the thrown position.

The lock-on assembly may comprise a pinion gear engaging with a rack of a crossbar, the crossbar arranged for engagement with the locking member to prevent retraction of the locking member from the thrown position to the retracted position.

The lock-puller may comprise a sliding crossbar, the crossbar having a wedge arranged to push against or be coupled to a protrusion on the locking member so as to drive the locking member from the retracted position to the thrown position. The crossbar may comprises an actuator such as a pin to be driven by the user to throw the locking member. The crossbar may be biased away from the locking member.

The pinion gear maybe arranged to be driven by a key cylinder or turn-knob.

The locking module may comprise a combination lock arranged to be driven upon receipt of a matching code, the locking module comprising the lock-off assembly.

The locking module may comprise a combination lock arranged to be driven upon receipt of a matching code, the locking module comprising the lock-puller assembly for throwing the locking member of the combination lock, the locking module adapted for use on a leaf, the combination lock configured for operation from a first side of the leaf and the lock-puller assembly configured for operation from a second side of the leaf.

The locking module may comprise an access control device and physical key driven device, the locking module adapted for use on a leaf, the access control device and key driven device configured for operation from a first side of the leaf and the lock-on assembly configured for operation from a second side of the leaf.

The present invention further provides a bolt module, comprising: a bolt moveable between a thrown position and a retracted position; a bolt drive assembly for accepting a drive element for driving the bolt between thrown and retracted positions; and a housing formed of a first housing portion and a second housing portion, at least the second housing portion having mountings for fixing to a leaf, wherein the first housing portion houses at least part of the bolt drive assembly and the second housing portion houses the bolt, the second housing portion having one or more guides to constrain the direction of movement of the bolt to movement between thrown and retracted positions, and the first and second housing portions are of different materials.

The guides may constrain movement of the bolt preventing transverse movement of the bolt.

The guides of the second housing may support the bolt to retain the thrown bolt in the absence of the first housing portion, when fitted to a leaf.

The second housing portion may have an aperture through which the bolt extends when securing the leaf.

The material of the second housing portion may have a higher melting point than the material of the first housing portion. The material of the bolt may have a higher melting point than the material of the first housing portion and may be substantially the same as that of the second housing portion.

The material of the second housing portion may be stainless steel, steel or a steel-based material. The material of the first housing portion may be aluminium, or an aluminium-based material.

BRIEF DESCRIPTION OF THE DRAWINGS

Embodiments of the present invention will now be described with reference to the accompanying drawings, of which.

DETAILED DESCRIPTION

Figure 1:
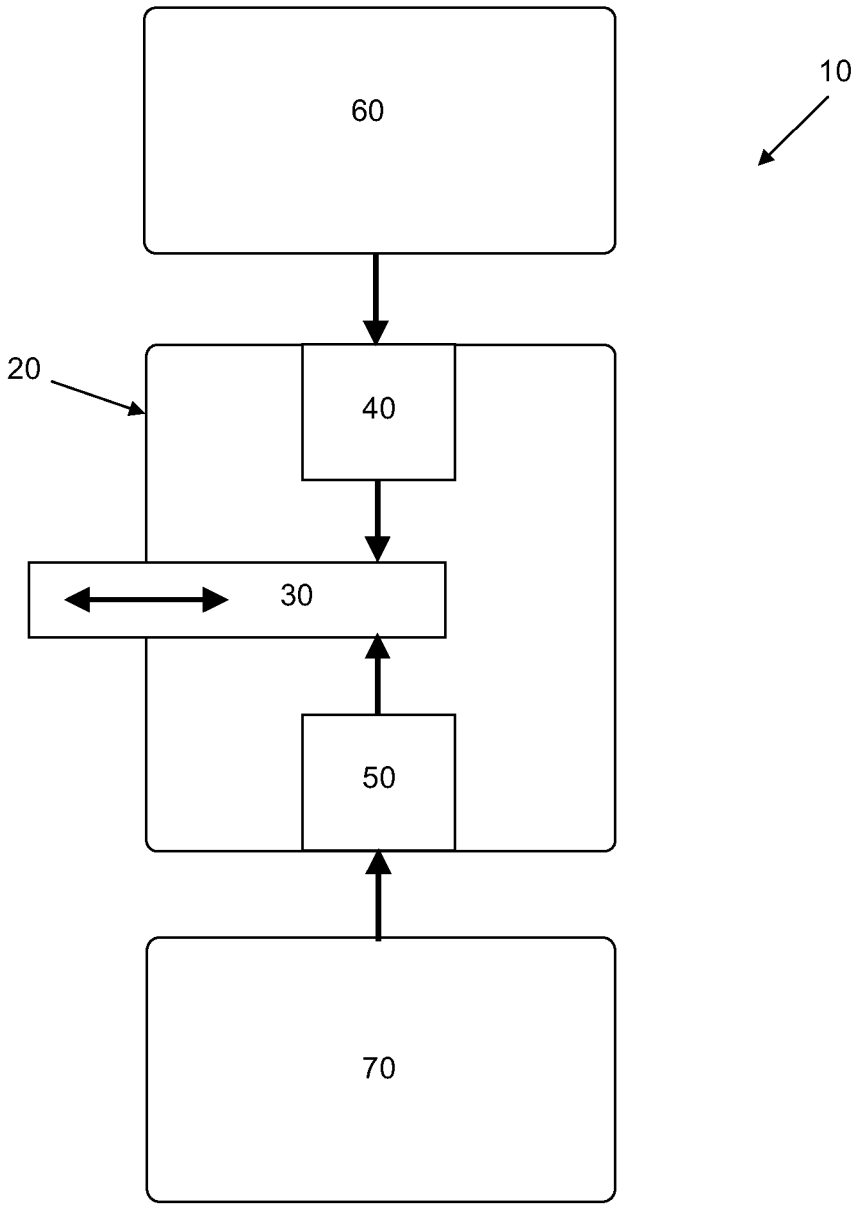
FIG. 1 is a schematic diagram of the lock system of the present invention.

FIG. 1 is schematic diagram of lock system 10. The lock system is for mounting on a door or other leaf for securing the door or leaf in a closed position. The lock system comprises a bolt module 20 having a bolt 30 arranged to be driven between a thrown position in which the bolt extends so as to secure a leaf. The leaf has an inside and an outside. Although we have described in the background section that the door is at the boundary of a building securing entry and exit to the building, it is alternatively envisaged that the door may be within a building such as proving controlled access and emergency egress into and out of a secure room. The system may also be used in other circumstances.

The bolt module 20 has rotor assemblies disposed on opposite sides of the bolt. The first rotor assembly 40 is shown above the bolt and the second rotor assembly 50 is shown below the bolt. Other arrangements are possible for the first and second rotor assemblies. The rotor assemblies are each arranged for operating the bolt 30, namely for moving the bolt between thrown and retracted positions. Each rotor assembly is capable of accepting drive elements from both sides of the leaf or bolt module, that is, from the inside and the outside. When driven the drive elements drive actuate the respective rotor assembly, or part thereof, to move the bolt between the thrown and retracted positions.

Each rotor assembly can therefore receive two drive elements, one for inside and one for outside. In total the bolt module may therefore receive four drive elements. However, it is expected that not all drive elements will be implemented in any given situation, but more likely one drive element will be provided on each side of the leaf, for actuation from inside and outside. In preferred embodiments the capability of additional or alternative drive elements are used for providing a reversible/invertible bolt system, whereby the direction of rotation of the drive elements can be selected according to the handedness of the door and without disassembly of the bolt module.

The lock system 10 also comprises a first locking module 60 and a second locking module 70. Both of the locking modules are arranged to operate on the bolt module 20. The first locking module 60 operates on the first rotor assembly 40, and the second locking module 70 operates on the second rotor assembly 50. Each of the locking modules 60, 70 is operable to lock at least a part of the respective rotor assembly 40, 50, said locking operating on the part of the rotor assembly driven by the outside drive element. Hence, this arrangement permits egress from the inside side of the locking module and leaf, for example, in an emergency by actuating a push pad, panic bar or touch bar. When locked the arrangement prevents the outside drive elements from driving the bolt, until the locking module is released. Locking of one or both of the locking modules prevents the bolt from being released.

The rotor assemblies 40, 50 are arranged such that to retract the bolt a drive element accepted by the first rotor assembly 40 is rotated in an opposite direction to a drive element accepted by the second rotor assembly 50. This provides invertible driving or reversible driving, without requiring disassembly, as we will now describe with reference to FIG. 1. A shown in FIG. 1, the bolt 30 protrudes to the left of the bolt module 20 when in the thrown position. The first rotor assembly 40 is arranged such that retraction of the bolt 30 is achieved by rotating a drive element accepted by the first rotor assembly 40 in an anticlockwise direction. The second rotor assembly 50 is arranged such that retraction of the bolt 30 is achieved by rotating a drive element accepted by the second rotor assembly 50 in a clockwise direction. The direction of driving to retract the bolt can therefore be selected by choosing to use a drive element with the first rotor assembly or the second rotor assembly. If it is desirable to have the bolt to be thrown on the right hand side of the bolt module 20, the whole bolt module can be rotated half a turn so that the bolt points to the right. Again a choice of driving direction is provided by selecting between the first and second rotors assemblies 40, 50. This reversible or invertible drive is provided for inside and outside driving.

Preferably the bolt module 10 also comprises an anti-thrust assembly (not shown in FIG. 1) which operates to block reverse driving of the bolt 30 by an external force on the end of the bolt. The anti-thrust assembly is released from acting on the bolt when a rotor assembly is driven.

Figure 2:
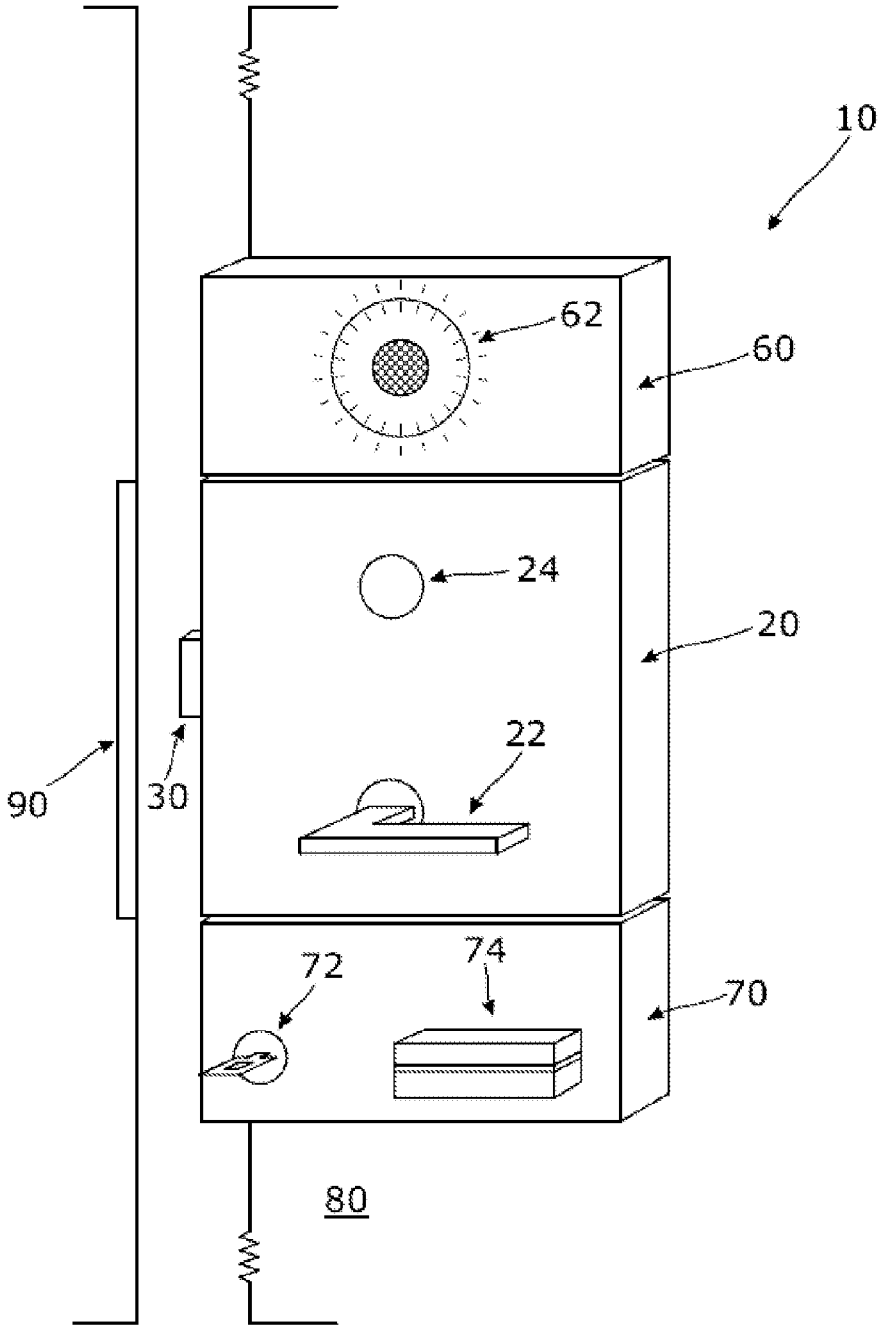
FIG. 2 is a perspective diagram showing an example implementation of the lock system of the present invention.

FIG. 2 shows an example implementation of the lock system 10. In this example, the lock system is mounted on a leaf 80. The bolt 30 of the bolt module is thrown into keeper 90 to secure the leaf closed. The bolt module 20 of the lock system 10 is provided with a handle 22 as a drive element. The drive element is arranged for driving of the outer side of the lower rotor assembly in the bolt module 30. This corresponds to the second rotor assembly 50 of FIG. 1. Driving of the upper rotor assembly 40 is covered off by a blanking plate 24. The lock system 10 also comprises first and second locking modules 60, 70 which in this example are a combination lock and access control unit. The combination lock is a rotary type combination lock such as may have a dial with numeric symbols around the circumference. Such a combination lock is based on a conventional combination lock in which the lock is released by turning the dial in opposing directions to a series of codes. Conventionally, release may trigger various actions to allow opening of a door, for example a safe door. In this example, release sends a signal, retracts a bolt or otherwise interacts with the bolt module to release at least a part of the first rotor assembly.

As mentioned above, the second locking module may be an access control unit. This may take various forms such as a numeric key pad, fingerprint identifier, card swipe etc. In FIG. 2 the example shows a card reader 74 across which a key card is swiped and read. The key card may comprise a magnetic strip or smart chip which stores a code or identification information. On reading this code or identification information the access control unit determines if access is to be allowed. The access control unit preferably includes a mechanical key override 72. The override may be used, for example, if there is a power loss to the access control module.

Operation of the exemplary lock system shown in FIG. 2 will now be described using the example of control access to a secure room. In this example, at the start of a day the locking modules 60 and 70 are in the locked position and the bolt 30 of the bolt module is in the thrown position securing the leaf closed. If the day is a week day a security manager may enter the correct code into the combination lock releasing the locking action of the first locking module 60 on the first rotor assembly of the bolt module 20. This releases the first level of security. At the end of the day, the combination lock is reactivated such that the first locking module locks the bolt module. Hence, if the security manager is not in the office, such as at a weekend or evening, the first locking module will lock the bolt module. The bolt will be locked in the thrown position. Locking of the bolt module prevents authorised users who have an appropriate swipe card or know the key code for the access control unit from gaining entry, for example, out of office hours. To gain access both locking modules must be released thereby providing two levels of security.

A small number of users or the security manager may carry the mechanical override key of the access control unit which overrides operation of the card reader or key pad etc. This may be used for example if the access control unit has failed, perhaps due to loss of power, or has been tampered with.

After both locking modules 60, 70 have been released the handle 22 can be actuated to drive the second rotor assembly and retract the bolt 30 thereby permitting entry.

The direction of rotation of the handle will be clockwise for the lock system orientation shown in FIG. 2. The handle actuates the second rotor assembly. If anti-clockwise rotation of the handle is required for retraction of the bolt, then the handle 22 should be swapped to the first rotor assembly by removing blanking plate 24 and using the handle to drive the first rotor assembly.

FIG. 2 shows a leaf with the lock system on the left hand side. For operation on the right hand side of a leaf the lock system can be inverted. For example, by rotating the bolt module 20 by half a turn the bolt 30 will be on the right hand side. If the handle had been coupled as shown in FIG. 2 to the second (lower) rotor assembly, after inversion the handle will be at the upper rotor assembly. Although the direction of rotation for withdrawing the bolt is unchanged, it may be desirable to also reverse the direction of rotation. This can be achieved by swapping the handle to the other rotor assembly. No disassembly of the bolt module 20 itself is required.

The lock system 10 comprises first and second locking modules 60, 70 as well as bolt module. It is envisaged that upon installation of the lock system, the bolt module will be installed first with the required orientation to match the door. The first and second locking modules are then installed. Although the interaction with the bolt module is unaffected whether, for example, the combination lock is the locking module above or below the bolt module, because of symbols or writing on the locking modules it may be desirable to fit the combination lock as the upper module. Similar considerations may apply to the second locking module.

Although we have described the first and second locking modules as respectively arranged above and below the bolt module, the bolt module may take other orientations depending on the leaf to which it is attached. For example, the bolt module may be arranged with the bolt operating upwards or downwards and the locking modules arranged at the sides.

Other types of locking modules are also envisaged such as requiring multiples mechanical keys or biometric information. The locking modules may be mechanical, electrical or a mixture of both.

Although FIG. 2 shows the bolt module and locking modules on the outside of a door for entering a room, they may be instead mounted on the inside of the door, with extended drive through the door and with those features requiring interaction with a user extending to the outside, for example the combination dial 62, handle 22, access control unit 74 and mechanical key override 72.

Figure 3:
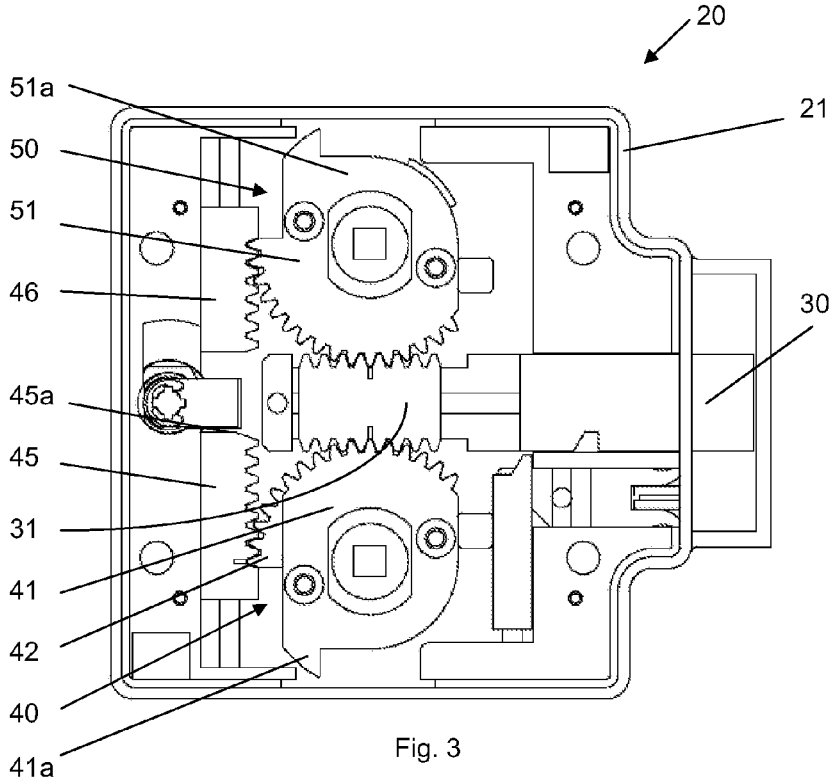
FIG. 3 is a plan view inside the bolt module showing internal components, with the bolt in the thrown position.
Figure 4:
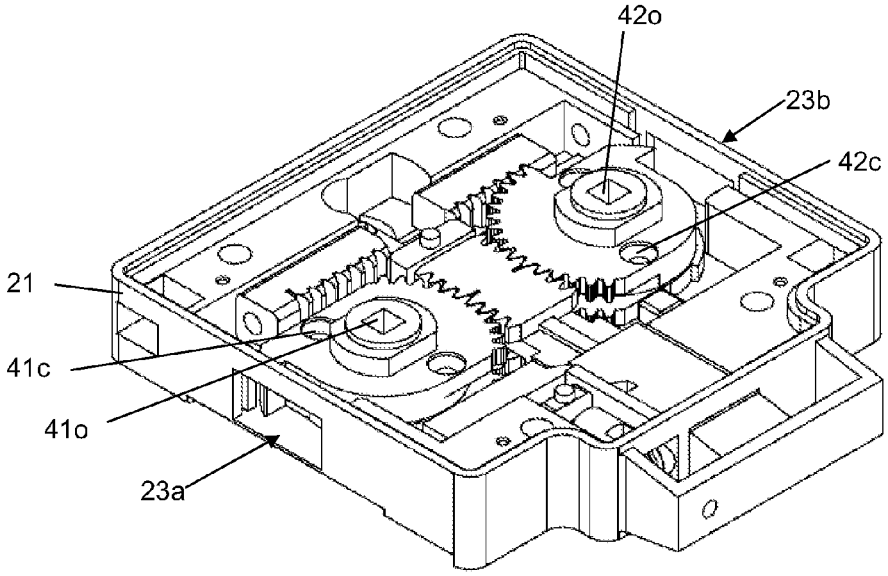
FIG. 4 is a perspective view of the bolt module shown in FIG. 3.
Figure 5:
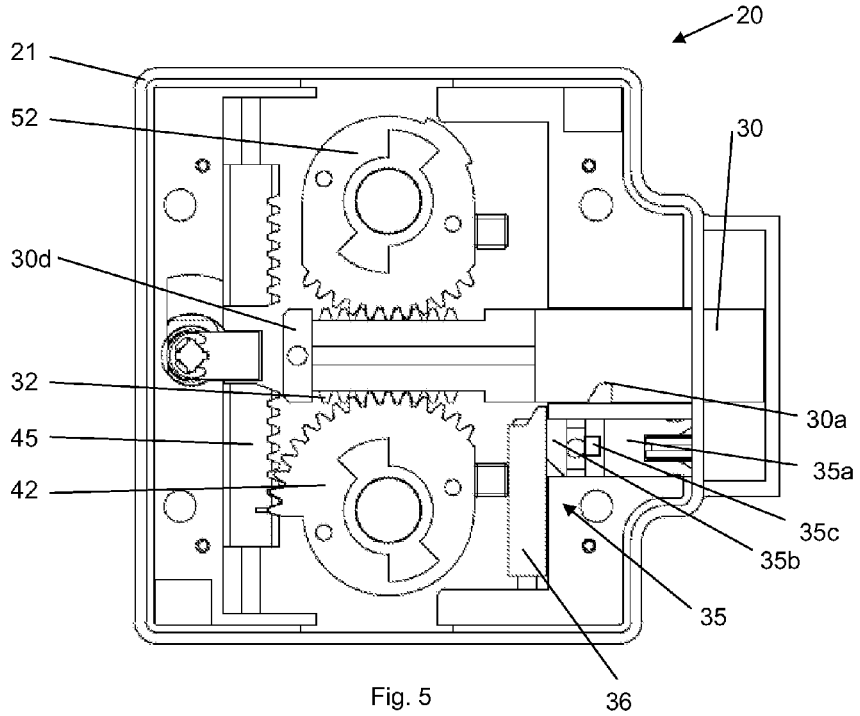
FIG. 5 is a plan view inside the bolt module of FIG. 3 showing internal components, with outside rotors and slider removed, and the bolt in the thrown position.
Figure 6:
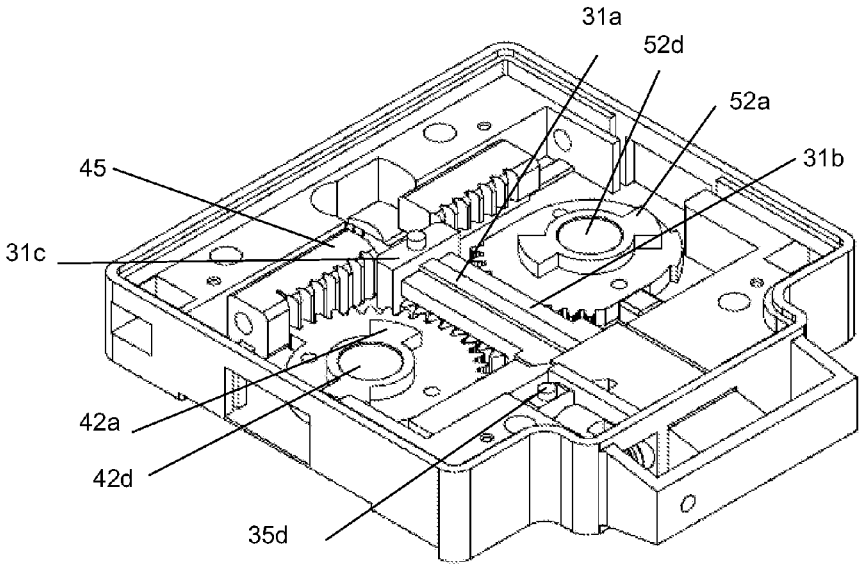
FIG. 6 is a perspective view of the bolt module of FIG. 5 showing internal components, with outside rotors and slider removed, and the bolt in the thrown position.
Figure 7A:
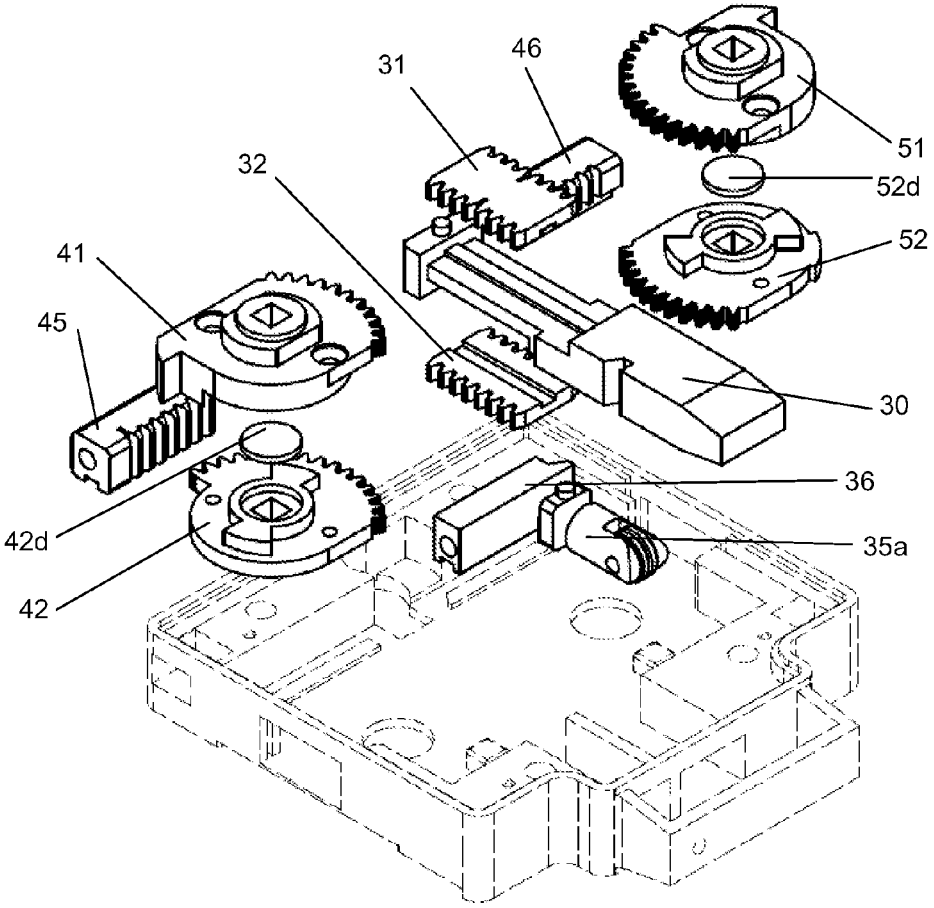
FIG. 7A is an exploded view of the bolt module of FIG. 3.

FIGS. 3 and 4 are respectively plan and perspective views of the bolt module 20 with a cover or housing panel removed. FIGS. 5 and 6 are plan and perspective views similar to FIGS. 3 and 4 but with the outside set of rotors (and slider) removed to show more clearly the internals of the bolt module. FIG. 7A is an exploded view of the bolt module showing many of the components in more detail than in FIGS. 3-6.

In FIG. 3 the bolt 30 can be seen in the thrown position. The bolt extends inwards into the module and much of the distance across the inside of the bolt module. Inside the bolt module the bolt has a recess 31*a* (see FIGS. 6 and 7A) and ends with a shoulder part 31*c*. The bolt has a guide pin 30*d* which is guided by a slot in cover (not shown in FIGS. 3-6). Inside the bolt module can be seen the outside rotors 41, 51 of the first 40 and second 50 rotor assemblies. Shown below the bolt in FIG. 3 is the outside rotor 41 of the first rotor assembly 40. Above the bolt is shown the outside rotor 51 of the second rotor assembly 50. In the embodiment shown in FIG. 3, the rotors are gears with teeth which engage with other gears or racks. In other embodiments the rotors may be coupled to neighbouring components by levers or belts. Returning to FIG. 3 the inside rotor 42 of the first rotor assembly 40 can also be seen behind the outside rotor 41. The terms "inside" and "outside" are used here to represent the sides from which the rotors are driven by drive elements, such as handles. This may be, for example, inside and outside of a room.

The inside and outside rotors are arranged to rotate on a common axis but are arranged to be able to rotate with some independence from each other. Each of the outside rotors 41, 51 is adapted to receive a spindle of a drive element. These are received in spindle apertures 41*o* and 51*o* (see FIG. 4). The outside rotors 41, 51 of the first and second rotor assemblies 40, 50 drive a slider 31. In the same was that the bolt module 20 has inside and outside rotors, it also has an inside slider 32 and an outside slider 31. The sliders transfer motion between the first and second rotor assemblies but also between the rotors and the bolt.

The teeth of outside rotor 41 of the first rotor assembly 40 and the teeth of the outside rotor 51 of the second rotor assembly 50 engage with the teeth of outside slider 31. As shown in FIGS. 4 and 6 outside slider 31 fits loosely in a recess 31*b* in the bolt 30. The bolt recess 31*b* also includes a guide 31*a* for guiding the movement of the slider. The guide 31*a* may be a ridge on the bolt 30 which sits in a channel in slider 31. The outside slider and bolt translate freely with respect to each other until the outside slider reaches an end of the recess 31*b*. At this point the slider is moved by the bolt or the bolt is moved by the slider. Hence, it may be considered that there is lost motion between the bolt and slider.

As shown in FIG. 3, the slider 31 comprises a pair of racks each for engagement or meshing with the teeth of the outside rotors or gears of the two rotor assemblies. FIG. 3 also shows two further racks with teeth for engagement with the rotor assemblies. Anti-thrust member 45 is one of those racks and is arranged to be driven by, or for driving of, the first rotor assembly 40. As shown in FIGS. 5 and 6 the teeth of the rack mesh with the teeth of the inside rotor 42 of the first rotor assembly. In the position shown in FIGS. 3 and 5 the anti-thrust member 45 blocks the inward movement of the bolt by end 45*a* of the anti-thrust member.

The other of the two additional racks is a bias member 46 which has teeth meshing with outside rotor 51 of the second rotor assembly, as shown in FIGS. 3 and 4. The bias member is biased to throw the bolt. The bias is provided by spring or resilient means between the housing 21 and an end of the bias member. In FIG. 3 this would be equivalent to a spring means pushing the bias member 46 downwards. The spring means may be a coiled spring or any other suitable spring means such as a lever spring.

Anti-thrust member 45 is also biased in a similar manner by a spring means between the housing 21 and the anti-thrust member. The anti-thrust member 45 is biased into the path of the bolt. In FIG. 3 the spring mean may be between the housing and the bottom of the anti-thrust member. The spring means may be, for example, a coiled spring or other suitable spring means as set out above for the bias member. The anti-thrust member also provides biasing to throw the bolt.

In an embodiment different to that shown in FIGS. 3-6 an additional anti-thrust member may be provided which mirrors anti-thrust member 45 and acts in the same way on rotor 52 as anti-thrust member 45 operates on rotor 42. This could be provided instead of bias member 46, or a thinned version of bias member 46 could be provided along with a thinned anti-thrust member such that one is underneath the other.

FIGS. 5 and 6 show the teeth of the inside rotors 42, 52 meshing with inside slider 32 beneath the bolt. Similarly to outside slider 31, inside slider sits in a recess in the underside of the bolt and its movement is guided by a guide on the bolt. The guide again may be formed of a ridge and channel. Different to the outside slider, the inside slider has only a small freedom of movement as the recess is significantly smaller, as shown in FIG. 7A.

Each of the rotors differs slightly since none of the rotors has gear teeth around the full circumference of the rotor. This is partly for compactness but also the gears turn less than a quarter turn.

From FIG. 3 there is apparent symmetry between the lower half (first rotor assembly 40 side) of the bolt module and the upper half (second rotor assembly 50 side).

Figure 7B:
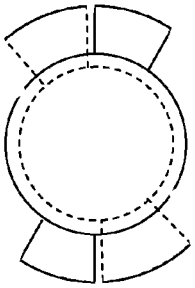
FIG. 7B is a schematic diagram of the device for lost motion between inside and outside rotors.

Inside rotors and outside rotors have lost motion between them such that the inside rotor can be turned without turning the outside rotor. Conversely, if the outside rotor is turned this will drive the inside rotor. Lost-motion in this way is present for both the first rotor assembly 40 and second rotor assembly 50. The spindle aperture for each outside rotor is not continuous with that of each inside rotor. Although they lie on the same axis a blocking disc 42*d*, 52*d* sits in a recess between the two rotors preventing a spindle of a drive element from engaging with both rotors directly. The lost motion is provided by lost motion device 42*a*, 52*a* on the inside rotors 42, 52 operating with a lost motion recess in the adjacent side of the outside rotor 41, 51. In the embodiment of FIGS. 5 and 6, the lost motion device comprises a bow-tie shape raised part or protrusion in the disc surface of the inside rotor. In the outside rotor there is provided a similar bow-tie shaped recess. As can be seen in FIG. 6 each of the two bow-tie ends form an arc of, at most, ⅛ of a circle. The corresponding recess in the outside rotor is slightly larger, taking up more of an arc, for example ⅙ or ¼ of an arc. FIG. 7B shows how the bow-ties parts interact such that when turned form one side both rotors turn together, whereas from the other side only one rotor turns. In other embodiments the lost motion may be provided by pins in slots or other suitable means.

Each of the outside rotors 41, 51 also comprises a stopping shoulder 41*a*, 51*a*. In FIG. 3 the bolt and mechanism of the bolt module are shown in the thrown position. In this position the stopping shoulder is at rest close to an aperture 23*a* or 23*b* in the housing so that it can be operated on by a locking module. The stopping shoulder is a protrusion extending from the disc of the rotor, and preferably extends further than the teeth. In other embodiments the topping shoulder may take other forms.

The rotors also comprise connection apertures 42*c* as shown in FIG. 4. The connection apertures are for receiving screws or bolts to link the inside and outside rotors together. A screw or bolt may be inserted or screwed through the aperture of the outside rotor and into a corresponding aperture of the inside rotor. The outside and inside rotors are then linked together. There may be implementations where it is advantages to link the inside and outside rotors of one of the rotor assemblies in this way. Connection apertures are provided in both of the rotor assemblies. This makes it possible to connect together inside and outside rotors for either rotor assembly, and hence may be set according to reversible operation. It is also possible to lock inside and outside rotors for both rotor assemblies.

We now describe operation of the bolt module 20 based on FIGS. 3-6. As mentioned above, in these figures the bolt and mechanism are in the thrown position with the bolt extended from the module, such as into a keeper in the fixed frame or jamb of a door or leaf. The bolt can be retracted by turning a drive element inserted in any of the rotors, if the locking modules are unlocked or not present. For simplicity we consider this arrangement first and we consider in turn insertion and actuation of a drive element into each of the four rotors.

Figure 8:
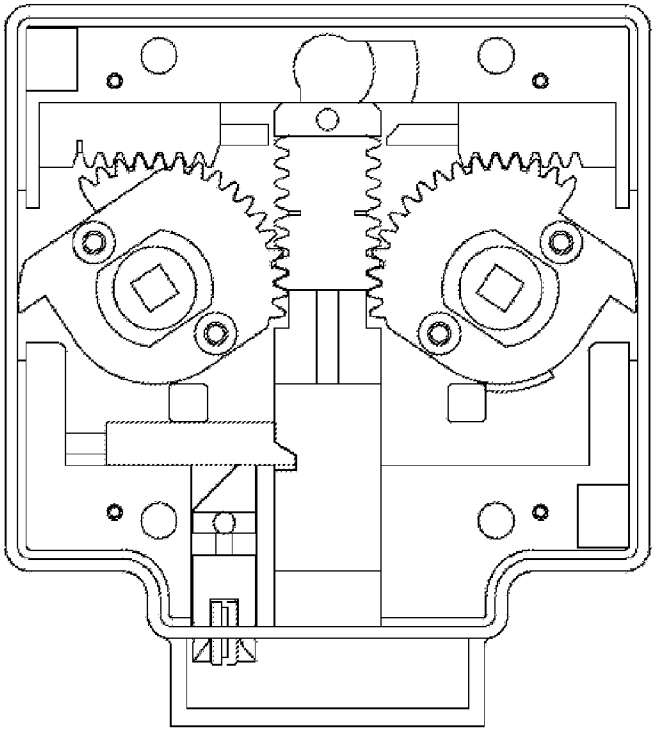
FIG. 8 is a plan view inside the bolt module showing internal components, with the bolt in the retracted position.
Figure 9:
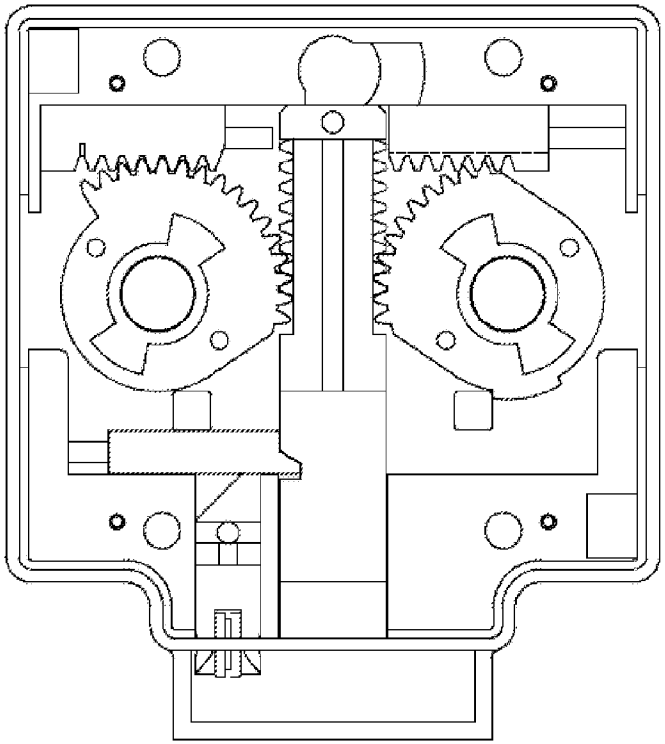
FIG. 9 is a plan view inside the bolt module showing internal components, with the bolt in the retracted position, and with outside rotors and slider removed.

FIGS. 8 and 9 show the bolt module with the bolt retracted. Similarly to FIGS. 5, FIG. 9 has the outer rotors and sliders removed.

Firstly we consider a drive element inserted into the outside rotor 41 of the first rotor assembly 40. Turning the drive element and outside rotor in an anti-clockwise direction causes teeth of rotor meshing with teeth of outside slider 31 to move slider sideways, to the left as shown in FIGS. 3 and 8. This movement of the slider also causes outside rotor of the second rotor assembly to rotate because the teeth of the outside rotor of the second rotor assembly mesh with the outside slider 31. The direction of rotation of the outside rotor 51 of the second rotor assembly 50 is the opposite to that of the driven outside rotor 41 of the first rotor assembly. Turning of the outside rotor 41 moves the outside slider towards the shoulder part 31*c* of the bolt 31. Continued turning of the outside rotor 41 drives the slider further sideways pushing the outside slider 31 against the shoulder part 31*c* to retract the bolt inwards. Driving of the outside rotor 41 of the first rotor assembly 40 also drives the inside rotor of the first assembly because the lost motion applies when driven from the inside only. Hence, rotation of the outside rotor 41 takes up any slack between the inside and outside rotors of the first rotor assembly. Continued turning of the outside rotor turns the inside rotor. As shown in FIG. 5, the inside rotor 42 of the first rotor assembly 40 has teeth which mesh with inside slider 32. Thus, turning of the outside rotor 41 assembly drives inside slider 32, which also moves against a corresponding shoulder of the bolt and acts to retract the bolt upon continue driving. The movement of inside slider rotates inside rotor of second rotor assembly. The direction of rotation of the inside and outside rotors 41, 42 of the first rotor assemblies is the same, namely anti-clockwise to retract the bolt. This is the opposite direction to the direction of rotation of the inside and outside rotors 51, 52 of the second rotor assembly, which is clockwise. Although preferably both sliders contact the shoulder parts of the bolt at the same time and so would withdraw the bolt evenly from both sides, as a result of differences in manufacture one of the sliders will likely contact the shoulder part slightly before the other slider, so that retraction of the bolt is performed by one of the sliders rather than both. However, both sliders will still move as will all four rotors, but the actual part pressing against the bolt to retract it may be only one of the sliders. If this is the case, it is preferable that the inside slider 32 acts first and retracts the bolt.

As the outside rotor 41 of the first rotor assembly is turned the concomitant rotation of the inside rotor 42 of the first assembly moves the anti-thrust member 45 out of the path of the bolt. As can be seen in FIG. 5, the inside rotor of the first rotor assembly has teeth extending around ⅓ of the circumference of the gear, which is more than the first rotor which has teeth extending around only a quarter of the circumference. The increased number of teeth is for this engagement with the teeth of the anti-thrust member 45, whereas the reduced number of teeth of the outside rotor 41 of the first rotor assembly is so as to avoid contact with the anti-thrust member 45. Upon turning of the outside rotor 41 the teeth of the inside rotor 42, which are meshing with those of the anti-thrust member, rotate moving the anti-thrust member 45 downwards and out of the path of the bolt.

On turning of the inside rotor the bolt 30 and the anti-thrust member 45 are both moved from the start of turning. Hence, the length the anti-thrust member protrudes in the path of the bolt, and the size of any gap between the bolt and anti-thrust member, are sized such that the anti-thrust member has been moved from the immediate path of the bolt just before the bolt arrives there.

The anti-thrust member 45 and recess 31*b* of the bolt permit a small amount of inward movement of the bolt when acted on by an external force on the bolt. The large recess and the smaller recess in the bolt permit this movement without moving the sliders. Upon pushing the bolt the sliders are not moved but the shoulder part 31*c* of the bolt quickly hits the anti-thrust member 45. The decoupling of movement of the bolt and the sliders in this way, under action of external force, prevents the external driving force on the bolt from reverse driving the rotors and other parts of the mechanism of the bolt module.

After retraction of the bolt 30 and opening of the leaf or door, the drive element may be released. The spring means operating on the anti-thrust member 45 and bias member 46 act to throw the bolt. The anti-thrust member 45 has teeth meshing with the inside rotor 42 of the first rotor assembly 40. As the spring means pushes the anti-thrust member back into the path of the bolt, the inside rotor is rotated. Rotation of the inside rotor moves the inside slider 31. As mentioned above, the inside slider has only a small freedom of movement before it starts to act on the bolt. Hence, rotation of the inside rotor causes the slider to move and throw the bolt. Movement of the inside slider 31 also causes the inside rotor of the second rotor assembly to return to its starting position. The action of returning the inside rotor 42 to its starting position also returns the outside rotor to its starting position. The return action on the outside rotors is two-fold here. The inside rotor 42 will drive the outside rotor 41 because the lost-motion device and recess are operating to transfer motion directly between inside and outside here. A face of the bow-tie device will act against a face of the bow-tie recess to return the outside rotor 41 at the same time the inside rotor 42 returns to its starting position. In addition the bias member 46 will act on the outside rotor 51 of the second rotor assembly 50 to return the outside rotor 51 of the second rotor assembly to its starting position. Through the concomitant motion of the outside slider, the bias member also acts to return the outside rotor to its start position.

As mentioned above the bolt 30 may be driven by a drive element acting on any of the four rotors. We have above described the drive element acting on the outside rotor or the first rotor assembly 40. Driving of the bolt by a drive element acting on the outside rotor of the second rotor assembly 50 is similar because the motion of the two outside rotors is directly linked by outside slider. The main difference here is that the direction of rotation of the second rotor is opposite to that required by the first rotor, namely it is clockwise compared to anti-clockwise. The result of this is that the direction of rotation of the drive element can be selected. For example, it may be desirable that the direction of rotation for retracting the bolt is always away from the edge of the door. This requires the direction of rotation to be different for left hand and right hand opening doors. Thus, the person fitting the lock system or bolt module can select the first of second rotor assembly for receiving the drive element based on the desired direction of rotation of the drive element.

Driving of the bolt 30 using drive elements inserted into inside drive rotors differs slightly compared to outside driving in that the lost motion between the inside and outside drive element is such that the outside rotors are not moved when the inside rotors are driven. This is because the lost motion between the inside and outside rotors permits the outside rotors to be locked by locking modules while leaving the inside rotors free to move. Accordingly the outside slider is also not moved.

FIG. 5 shows the bolt module with the outside rotor removed. Hence, when considering driving by the inside rotors it is convenient to refer to this figure. Driving of the inside rotor of the first rotor assembly 40 using a drive element requires rotation of the outside rotor in a clockwise direction as viewed from the inside (anticlockwise as viewed from the outside in FIG. 5). Rotation of the first rotor simultaneously drives the anti-thrust member 45 and inside slider 32. As discussed above the rotation of the inside rotor 42 of the first rotor assembly begins by moving the anti-thrust member 45 such that as any freedom of movement between the slider and bolt is taken up and the bolt begins to be retracted, the anti-thrust member is moved out of the path of the bolt. Continued rotation of the inside rotor of the first rotor assembly 40 retracts the bolt, as shown in FIG. 9. Inside slider 32 transfers movement from the inside rotor 42 of the first rotor assembly 40 to the inside rotor 52 of the second rotor assembly such that as the inside rotor 42 is rotated clockwise, the inside rotor 52 of the second rotor assembly 50 rotates in the opposite direction. The outside rotors 41, 51 of the first and second rotor assemblies are not moved by the inside rotors when one of the inside rotors is the driven rotor. The outside rotors are maintained in position because bias member 46 is operating on the outside rotors to bias the outside rotors in the thrown position. As the bolt is retracted by the inside rotor, the outside slider is also not driven by the bolt because of the large recess 31*b* in the outside of the bolt. Hence, as the bolt is retracted the movement of the bolt does not drive the outside slider 31.

After the bolt has been retracted and the door opened, the bolt is returned back to the thrown position by action of the bias member 46 and the anti-thrust member 45. The bias member 46 acts on the outside rotors which are not moved when the bolt is driven by the inside rotors. The anti-thrust member 45 is biased by spring means which moves the anti-thrust member upwards. This rotates the inside rotor of the first rotor assembly in an anti-clockwise direction as viewed from the inside (clockwise as viewed in FIG. 5). This drives inside slider 32 to drive the bolt 30 outwards to secure the door. Movement of the inside slider 32 also drives the inside rotor of the second rotor assembly returning it to its thrown position. No movement of the outside slider occurs. Once back in the thrown position the anti-thrust member 45 has also moved upwards to block the path of the bolt from forced retraction.

For the bolt module, on the face of it there is some symmetry between inside rotors and outside rotors, and also between first rotor assembly and second rotor assembly. However, the different manner in which the sliders operate along with the lost-motion between inside and outside rotors gives various different operating modes and directions as discussed above.

The inside rotor 42 of the first rotor assembly 40 is operated on by the inside slider 32 and the anti-thrust member 45. The outside rotor 51 of the second rotor assembly 50 is operated on by the outside slider 31 and the bias member 46. Correspondingly both of these rotors 42, 51 have teeth extending around a larger part of the circumference of the rotor than the rotors 41 and 52, namely around approximately ⅓ of the circumference. Outside rotor 41 of the first rotor assembly 40 and inside rotor 52 of the second rotor assembly are operated on by the outside and inside sliders respectively. These rotors 41 and 52 have teeth extending around approximately only a quarter of the circumference of the rotor.

As can be seen in FIGS. 3 and 5 each of the four rotors may have a flat edge for support or butting against an internal structure within the housing. In particular, in FIG. 5 the right hand side of the inside rotors have a flat part that buts against an internal structure within the housing. In the case of the inside rotor 42 of the first rotor assembly, in the thrown position the flat side of the rotor butts against the internal structure and acts a stop to prevent further driving beyond the thrown position. As the rotor is turned the curved surface of the rotor is also guided by the internal structure. The inside rotor 52 of the second rotor assembly 50, and both outside rotors 41, 51 are also guided and stopped in a similar manner.

Figure 25:
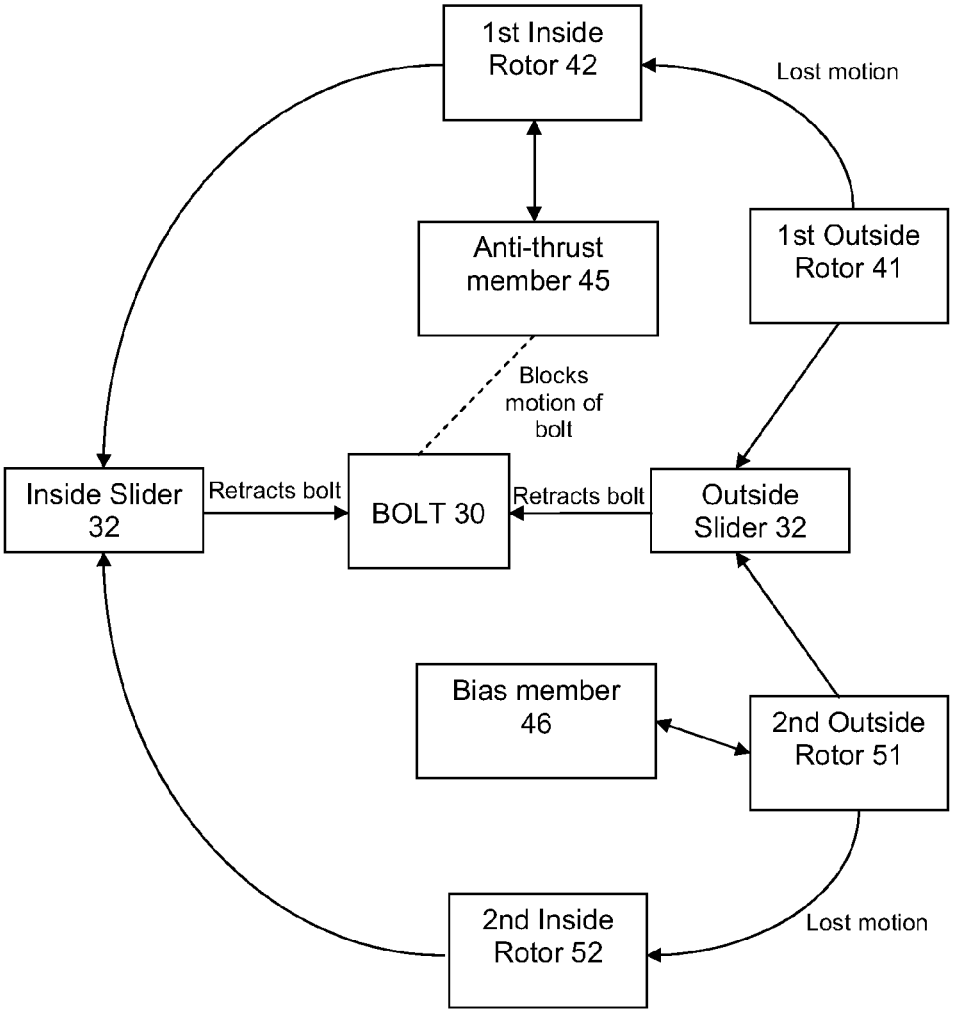
FIG. 25 is a flow chart summarising operation of the bolt module according to an embodiment of the invention.

FIG. 25 is a flow chart summarising the action of the various components of the bolt module on each other. The direction of the arrows indicates the direction motion or drive is transferred between components. For example, the bolt may be retracted by action of the inside slider or outside slider. The outside rotors drive the inside rotors, but the inside rotors do not drive the outside rotors when driven by a drive element. The anti-thrust member and bias member provide return bias to the inside and outside rotors respectively. The dotted line shows the anti-thrust member blocks motion of the bolt.

As shown in FIGS. 3-6 the bolt module may also comprise a latch and trigger arrangement 35 for latching and releasing the bolt. The bolt 30 has a notch 30*a* cut into it for engagement by bolt restraint latch 36. Bolt restraint latch 36 is biased towards the bolt 30, preferably by a spring means similar to those biasing the anti-thrust member 45 and bias member 46 but other spring means may be used. The bolt restraint latch has an engagement portion at the end of the latch for engaging in the notch 30*a*. The notch and engagement portion are tapered such that as soon as the bolt is retracted far enough for the narrowest part of the engagement portion to be received by the notch, the bias of the restraint latch pushes the latch fully into the notch. By pushing the latch fully into the notch, the tapered portion also provides some force pushing the bolt back. Upon latching of the bolt, the bolt is held in the retracted position.

As shown in FIG. 5 the latch and trigger arrangement 35 also includes a trigger finger 35*a* for release of the bolt restraint latch 36. Where the trigger finger 35*a* sits against the restraint latch 36, the trigger finger has a latch pusher 35*b* and threaded rod 35*c*. The latch pusher and trigger finger have angled surfaces arranged in correspondence to each other and riding against each other. The angled part of the trigger finger is arranged such that horizontal movement of the trigger finger drives the bolt restraint latch upwards releasing the latch.

As discussed above, when the latch is retracted the bolt restraint latch 36 engages in the notch 30*a* in the bolt restraining the bolt. In this position the bolt restraint latch 36 has moved upwards pushing the trigger finger outwards from the housing adjacent or close to where the bolt extends and retracts from.

The trigger finger is adjustable such that actuation to release the bolt is achieved for a range of gaps between the door or leaf and door jamb or door frame. If the trigger finger is not depressed far enough the bolt restraint latch may not be released. Thus, if the gap between the door and the door jamb is too large the trigger finger may not release, or may only partly release, the bolt restraint latch. The adjustment is provided by the threaded rod 35*c* and the latch pusher 35*b*. The latch and trigger arrangement may be disassembled from the bolt module during fixing to the door or leaf to set the extent that the trigger finger extends. The adjustment is achieved by adjusting the distance from the external tip of the trigger finger to the angled surface of the latch pusher. Between the trigger finger 35 and latch pusher is a threaded rod 35*c*. The trigger finger is cylindrical and may have a roller at its exposed end. trigger finger can be rotated in-situ with respect to the latch pusher thereby unscrewing and extending the length of threaded rod to increase the distance from the tip of the trigger finger to the angled surface of the latch pusher. Unintended rotation of the trigger finger is prevented by a sprung detent, such as a ball-bearing detent, acting in a groove. The trigger may therefore be set for larger gaps between door jamb and leaf such that the trigger releases the latch. Correspondingly, if the trigger finger drags or catches on the door jamb because the trigger finger extends too far, the length from the tip of the trigger finger to angled surface of the latch pusher may be reduced by screwing the latch pusher in the opposite direction, thereby reducing the portion of threaded rod exposed between the trigger finger and latch pusher.

The latch pusher also comprises a guide pin 35*d* which moves with the latch pusher and is guided in a slot in cover of the bolt module which is removed in FIGS. 3-6.

After adjustment, upon depression of the trigger finger the latch pusher drives the bolt restraint latch downwards. The bolt restraint latch 36 must be fully pushed downwards such that the tip of the restraint latch is released from the notch on the bolt. If not fully released the bias on the restraint latch 36 will push the tip into the notch 30*a* and continue to restrain the bolt 30. When the trigger finger is fully depressed, the restraint latch will no longer be in the notch of the bolt and the bias on the bolt, through the rotors, will drive the bolt to the thrown position.

The bolt restraint latch 36 and trigger finger 35*a* provide the advantage of restraining the bolt such that it does not catch or drag against the door jamb. The trigger finger provides release of the bolt such that the bolt is thrown into the keeper when the door or leaf is pushed closed.

As mentioned above in relation to FIGS. 1 and 2, the locking system includes the bolt module and locking modules. First and second locking modules operate on, or interact with, the outside rotors of the first and second rotor assemblies respectively. When either of the first or second locking modules is locked, the outside rotors cannot be turned and retraction of the bolt can only be performed from the inside. Detailed description of the locking modules now follows.

Figure 10:
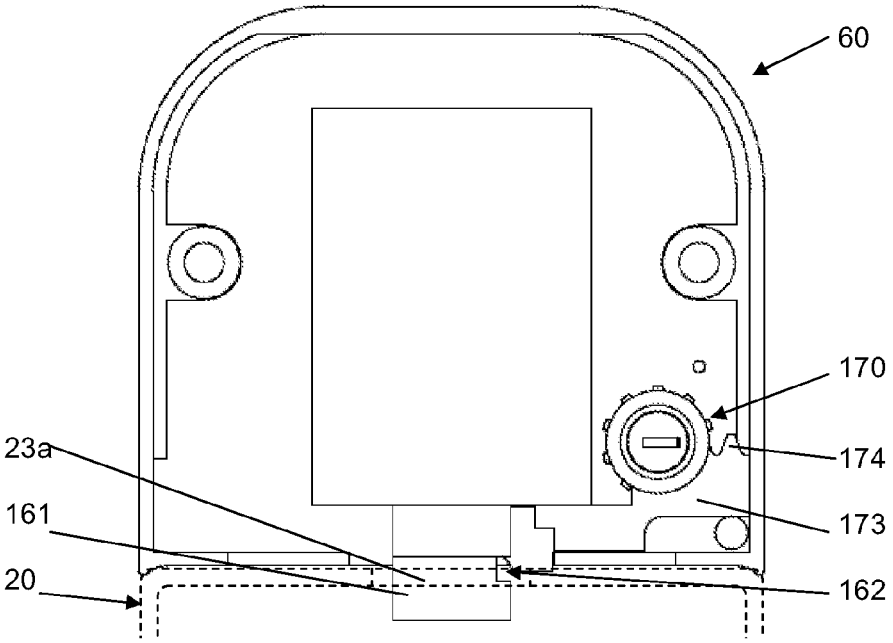
FIG. 10 is a plan view inside the first locking module, showing combination lock and lock-off features.
Figure 11:
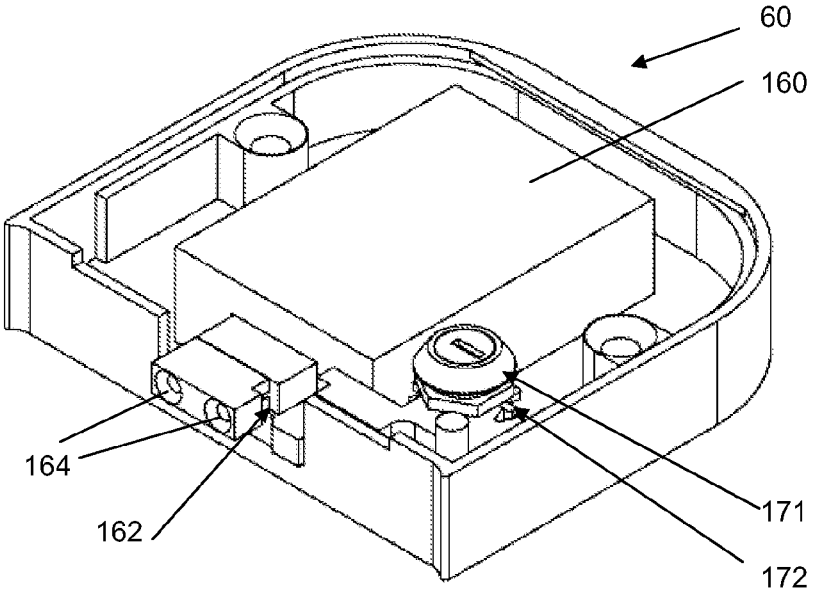
FIG. 11 is a perspective view of the first locking module of FIG. 10.
Figure 26:
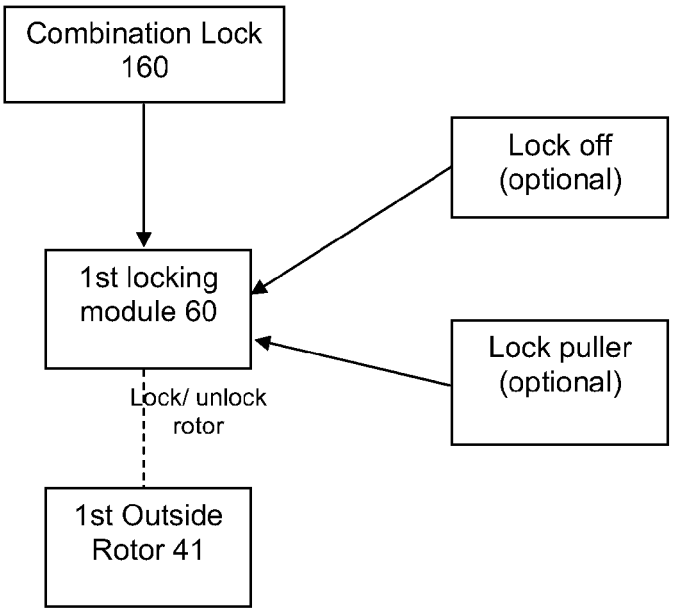
FIG. 26 is a flow chart summarising operation of the first locking module according to an embodiment of the invention.

Locking modules are provided to lock the bolt module and prevent actuation from the outside. FIGS. 10 and 11 show an example of the first locking module 60 which includes a combination lock 160. In other embodiments the first locking module may be a different type of lock. FIG. 10 is a plan view of the first locking module and FIG. 11 is a perspective view. In both figures the module cover is not shown. FIG. 26 is a flow chart showing the relationship between the functions of the first locking module and the outside rotor 41 of the bolt module.

The combination lock 160 may be a conventional unit which is provided with its own housing for ease of assembly into first locking module. In some embodiments additional functionality beyond that of a conventional combination lock may be required. This may be achieved by a custom combination lock or may be achieved through using a conventional combination lock and adding functionality within the first locking module. In the present embodiment a conventional combination lock is used and additional functionality is added in the first locking module 60. In this embodiment two additional functions are desirable. The first is a "lock-off" function in which the locking function of the first locking module on the outside rotor of the first rotor assembly of the bolt module 20 is locked in the free-to-move or unlocked position. The function has the advantage that if a user has entered the room or building which is secured by the lock system, the locking function of the first locking module can be turned off to avoid inadvertently being locked in the room or building. In our original example, it was stated that the combination lock could be considered the primary locking module and would be released during the day. The "lock-off" is therefore desirable to prevent inadvertently locking the user in at the end of the day. A second function that it is desirable to include is a "lock-puller" function in which the locking member of the first locking module can be thrown by an action on the inside of the leaf or door to which the lock system is attached. This avoids the user having to throw the locking member after they have exited the room or building, but they can do so on opening the door as they leave.

We now describe the "lock off" feature as implemented and shown in FIGS. 10 and 11. The combination lock has a locking member 161 which is thrown outwardly in the locked position and retracted when in the unlocked position. As can be seen in FIGS. 10 and 11, when in the thrown position the locking member 161 passes through the aperture 23*a* in the housing of the bolt module 20 and blocks the path of rotation of the stopping shoulder 41*a* of the outside rotor 41 of the first rotor assembly. In the unlocked position the locking member is retracted such that it does not extend through the aperture 23*a* and does not interact with the first rotor or block the path of its stopping shoulder. There are other alternatives for blocking rotation of the outside rotor. For example, the locking member 161 could include teeth to engage with teeth on the outside rotor preventing its movement, or a pin of the locking member could engage with a notch or channel in the rotor. Other alternatives are also possible.

The "lock-off" function is provided by "lock-off" assembly 170. The "lock-off" assembly 170 comprises key cylinder 171, pinion gear 172 and crossbar 173. The crossbar 173 includes a rack 174. Pinion gear 172 is driven by key cylinder 171. The teeth of pinion gear mesh with teeth of rack 174 on crossbar 173. Crossbar 173 extends towards the locking member 161 of the combination lock 160. Locking member 161 of combination lock 160 includes a notch cut therein to align with the crossbar 173 when the locking member is retracted. Operation of the lock off function is as follows. On insertion of a matching key into key cylinder 171, the key may be turned. The rotation of the key rotates pinion gear 172. When viewed as in FIG. 10, and the key is turned clockwise the crossbar will be driven sideways to the left towards the locking member 161. In FIG. 10 the locking member 161 is in the thrown position operating on the outside rotor 41 of the bolt module 20. If the locking member 161 was in the retracted position, continued driving of the crossbar by the key cylinder would cause the distal end of the crossbar to engage in notch 162 in locking member. This prevents the locking member 161 from being thrown even if the combination or code is correctly entered into the combination lock. Release of the "lock-off" feature is achieved by rotating the key in the key cylinder in the opposite direction to release the crossbar 173 from the notch 162. The key cylinder may be of the type in which the key is retained when the "lock-off" feature is activated, such that the feature is deactivated whenever a user leaves the room and takes his keys with him.

In the embodiment shown in FIGS. 10 and 11 the combination lock 160 is a conventional unit and the locking member is modified by extension to include the notch 162. The extension is attached to the end of locking member 161 using screws or bolts 164. In other embodiments a custom combination lock may be used with the notch already incorporated therein. Other arrangements for achieving the lock-off feature are possible such as a pin engaging in a slot, or a slide being driven in front of the end of the locking member, by mechanical or solenoid means.

Another reason for implementing the "lock off" feature is if there is no emergency exit facility provided, which would normally be provided by a drive element operating from the inside on one of the inside rotors.

Figure 12A:
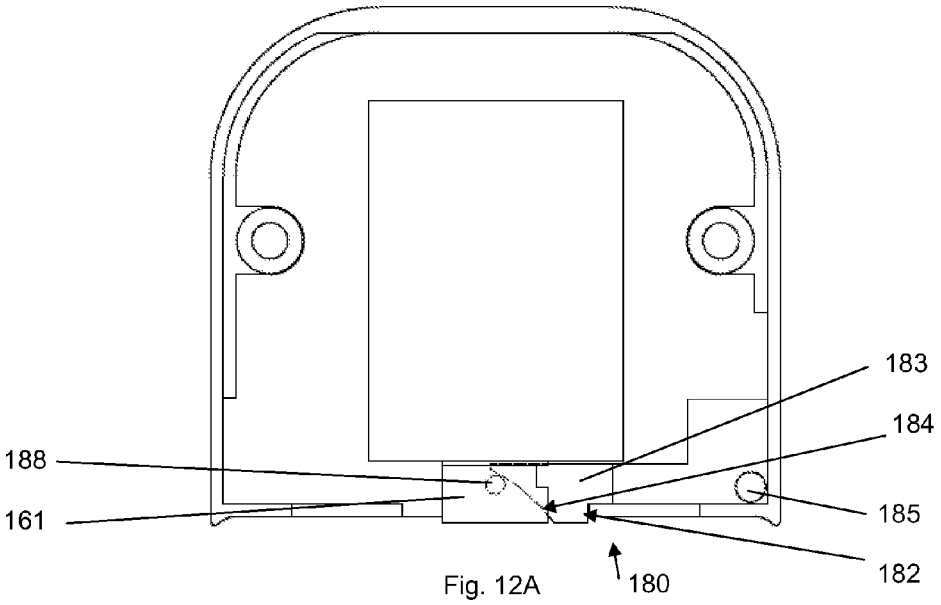
FIGS. 12A and 12B are plan views inside the first locking module, showing combination lock and lock-puller features, with lock-off features removed, and the locking member respectively retracted and thrown.
Figure 12B:
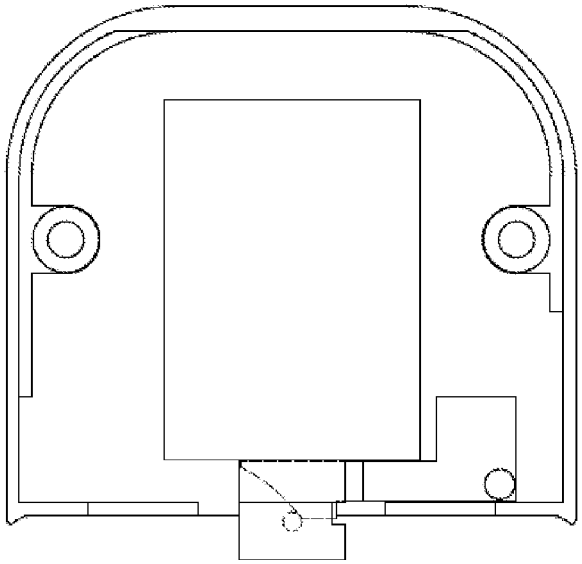
Figure 13:
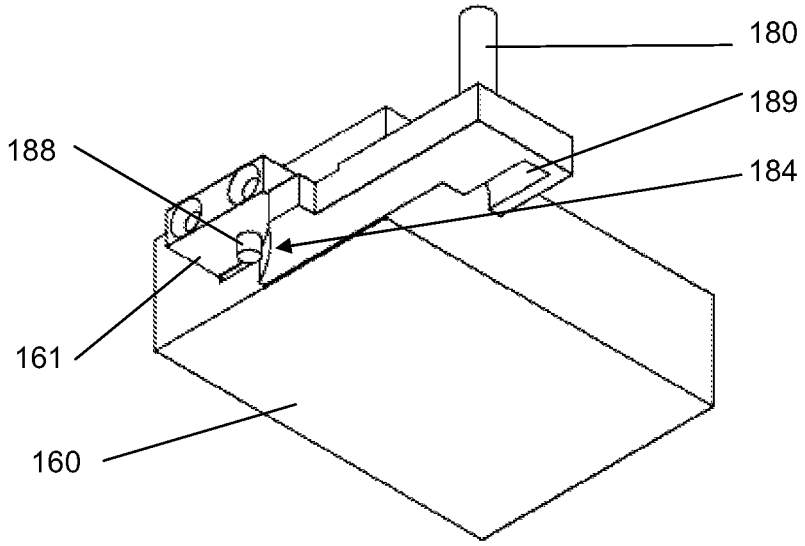
FIG. 13 is a perspective view of the combination lock and lock-puller removed from the first locking module.

As discussed above the first locking module 60 may also be provided with a "lock-puller" function. This is shown in FIGS. 12A, 12B and 13. For simplicity this feature is shown separately from the "lock-on" feature of FIGS. 10 and 11. In FIGS. 12A and 12 the components for the "lock off" feature have been removed, because from the view point of the figures the "lock puller" feature is underneath the "lock off" components. The removed components include the camlock or key cylinder and crossbar. For clarity FIG. 13 shows the combination lock 160 and lock-puller features 180 from the underside and removed from the first locking module. In the arrangement shown in FIGS. 12A, 12B and 13 the "lock-puller " assembly 180 comprises a crossbar 183 having a wedge 184 and drive pin 185. The locking member of combination lock is modified to have pin 188. The pin could alternatively be any other protraction such as an angled face which moves when driven by the wedge. The pin extends transversely to the direction of the movement of both the locking member 161 and the crossbar 183. The combination lock 160 has the function that the locking member 161 can be thrown manually by action of a force on the locking member. The crossbar 183 is arranged to move in a direction transverse to the direction of the locking member 161. The drive pin 185 is located at one end of the crossbar and the wedge 184 is at the opposite end of the crossbar. The drive pin could be located at other positions along the crossbar. The wedge may be at an angle between the directions of movement of the crossbar and locking member, such as at angle of 45 degrees to them. The wedge may include some curvature to ease movement and actuation.

In FIG. 12A the locking member 161 is shown in the retracted position. The interaction between the wedge 184 and pin 188 of locking member 161 is shown more clearly in FIG. 13. Here it can be seen that the wedge is in contact with the pin 188. The lock-puller is operated by the user pushing the drive pin 185 in a sideways direction towards the centre of the locking module. In FIG. 12A the sideways direction is to the left. The sideways action of the wedge 183 on pin 188 of locking member is transformed into a downwards motion of the locking member. As shown in FIG. 12, the locking member is pulled down into the thrown position when the crossbar and wedge are fully pulled sideways. Drive pin 185 will move, and be guided in a slot in a cover to the first locking module. The drive pin 185 will also protrude through that cover so that it can be driven by the user.

The crossbar 183 is located adjacent to the aperture in the first locking module through which the locking member 161 is thrown. The cross bar 183 may include a knee 182 which also sits in the aperture. When the lock puller is not activated the knee rest against the edge of the aperture and acts as a guide when the cross bar is moved.

The cross bar is biased away from the locking member by a spring in pocket 189 which pushes against the body of the combination lock. After the lock-puller has been activated and the locking member 161 of the combination lock has been thrown, the crossbar retracts away from the locking member and the pin 188 leaving the locking member free to move. The locking member will stay in the thrown position until acted on by the combination lock dial. If the crossbar did not move clear the locking member would not be able to be driven by the combination lock dial. When sprung to the inactive position the knee 182 of lock puller pushes against the edge of the aperture in the locking module acting as a stop.

The lock puller may take other forms such as be driven by a pinion gear arrangement, a pin in a slot, or other means, but the above arrangement is preferred since it allows the lock puller to be biased clear of the locking member. The lock puller may also be used on other types of locking module than the combination lock.

As mentioned above, combination locks in general allow have the functionality to allow the locking member to be pulled or thrown, independently of the dial. When the combination lock is retracted by operation of the combination lock dial, the correct combination or sequence of numbers or setting is required to be input. The inputting of the numbers commonly involves turning the combination dial to one number then in the opposite direction to another number, and repeating for as many numbers are required. This inputting of numbers aligns the inner workings. Once all numbers have been input the dial is continuously turned a number of turns in one direction to retract the bolt. This final turning to retract the bolt scrambles the inner workings so that one opened the combination lock code will need to be entered again. Hence, the lock puller above does not also need to scramble the dial codes as this occurs automatically when the combination lock is first unlocked.

Figure 27:
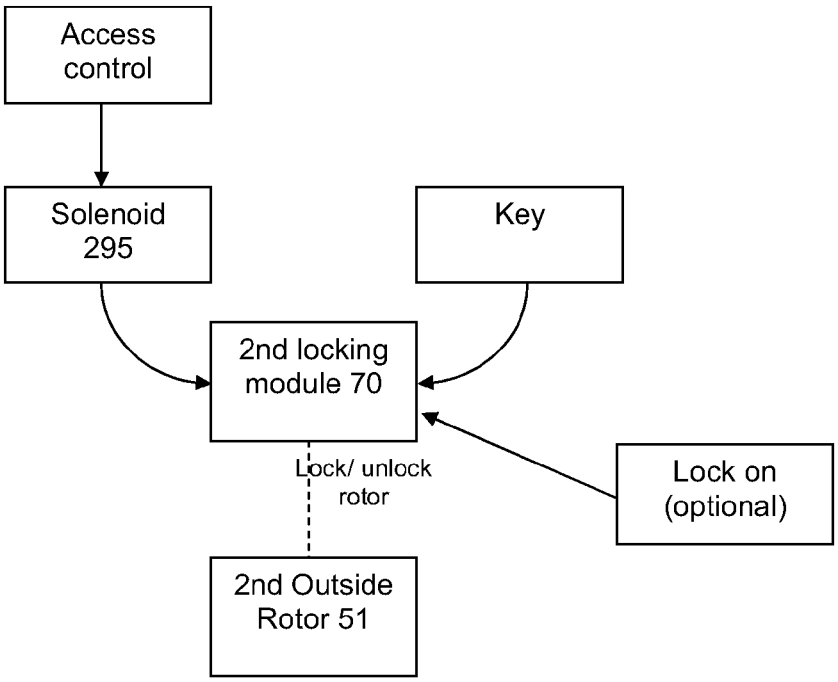
FIG. 27 is a flow chart summarising operation of the second locking module according to an embodiment of the invention.

FIGS. 14A, 14B, 15A and 15B show second locking module 70 with the cover removed. These figures respectively show perspective and plan views with the locking member thrown and retracted. FIG. 27 is a flow chart showing the relationship between the functions of the second locking module and the outside rotor 51 of the bolt module. The second locking module 70 comprises mechanical and electronic access means. The electronic access is preferably provided by an access control unit such as a numeric key pad or swipe card, such as shown in FIG. 2. On receipt of a matching code or swipe card the access control unit activates electromechanical device, such as solenoid 295 shown in FIGS. 14 and 15. Override of the access control unit is provided by a mechanical key actuating a key cylinder.

The electronic access part of the second locking modules comprises an electromechanical drive device, such as solenoid 295 which when energised drives a solenoid piston 296. The solenoid piston 295 is coupled to a drive bar 293 which forms part of the mechanical drive of the locking member 271. The drive bar is an arm having a first end and a second end, with a pivot between the two ends. The two ends are not in a straight line but from a dog-leg, L-shape or J-shape. In the preferred arrangement in FIGS. 14 and 15, the arm has two dog-legs or angled parts. A first dog-leg is formed by a first obtuse angled corner close to the pivot and which bends in a first direction. A second dog-leg is formed by a second obtuse angled corner part way between the pivot and its coupling to the locking member. The second dog-leg or angled part bends in a second direction, opposite to the first direction. The part of the arm between pivot and connection to electromechanical drive device is approximately parallel to the part between second corner and the coupling to the locking member. The solenoid piston may be connected to the drive bar by a clevis pin. The clevis pin passes a fork in the end of the drive bar causing the solenoid piston and drive bar to move in both directions (for retraction and throwing of locking member) together.

A pin is provided towards the second end of the drive bar. The solenoid couples to the first end of the drive bar. An extension spring acts on the solenoid piston 296 to return it to its deactivated position when the solenoid 295 is turned off.

A key cylinder is also provided for driving the locking member. The key cylinder barrel drives a tang 281 which acts on the drive bar. Preferably the tang operates towards the second end of the drive bar. Rotation of the key cylinder causes the tang to rotate. The tang 292 has a cross-section which is similar to a chord of a circle.

The locking member 271 is arranged to be thrown and retracted through an aperture in second module housing. The aperture is coincident with aperture 23*b* in bolt module. The part of the locking member which protrudes through the aperture may be considered to have a first width. The locking member comprises a slot 273 in which is located a pin 293*a* of drive bar 293. The slot is offset to the side from the axis of the locking member. The slot is arranged transverse to the direction of movement of the locking member. The drive bar crosses the axis of the bolt.

The locking module preferably, although not necessarily, includes an anti-thrust feature which prevents an external force acting on the locking member from retracting the locking member. The anti-thrust feature comprises an anti-thrust lever 282 and anti-thrust block 281. The anti-thrust block is preferably part of the casting of the housing and is a pillar or protrusion. The anti-thrust lever 282 may be L-shaped and is arranged to pivot about its elbow. The anti-thrust lever 282 is coupled to the drive bar 293 at the pivot of the anti-thrust lever.

Operation of the second locking module will now be described. The locking member may be retracted by action of the solenoid or key cylinder. We first describe operation by the solenoid. Upon a user meeting the entry requirements of the access control unit, a signal is sent to energise the solenoid thereby driving solenoid piston lengthways. The solenoid piston 296 is coupled to first end of drive bar 293. The drive bar rotates about pivot. As the first end of the drive bar moves towards the solenoid, the pin 293*a* at the second end of the drive bar moves about an arc retracting the locking member 271. As the drive bar moves along the arc, the pin 293*a* moves along the slot 273 in the locking member at the same time as retracting the locking member. The solenoid and locking member are preferably sprung to return them to the thrown position when the solenoid is de-energised.

The tang 292 of key cylinder can also be used to retract the locking member. Rotation of the key cylinder by turning of a matching key inserted in to the key cylinder causes the tang to rotate. The tang is offset from the centre of the key cylinder and so also describes an arc as it is rotated. Although not shown in the figures, rotation of the tang pushes against the second end of the drive bar moving it in a similar manner to the action of the solenoid. Hence, rotation of the tang pushes on drive bar causing it to rotate in an arc and retracting the locking member.

On driving the drive bar, the anti-thrust feature needs to be released. The pin 293 of drive bar is smaller than the width of the slot 273 in locking member. As the drive bar is rotated, the pin moves transversely across the slot and pushes against part 282*a* of the anti-thrust lever 281 causing the anti-thrust lever to rotate. The anti-thrust lever is now moved out of the path of anti-thrust block 281 permitting retraction of the locking member. Conversely, if an external force is applied to the end of the locking member to try to retract it, the anti-thrust lever pushes against anti-thrust block 281 preventing the lock from being moved to a retracted position.

Figure 14A:
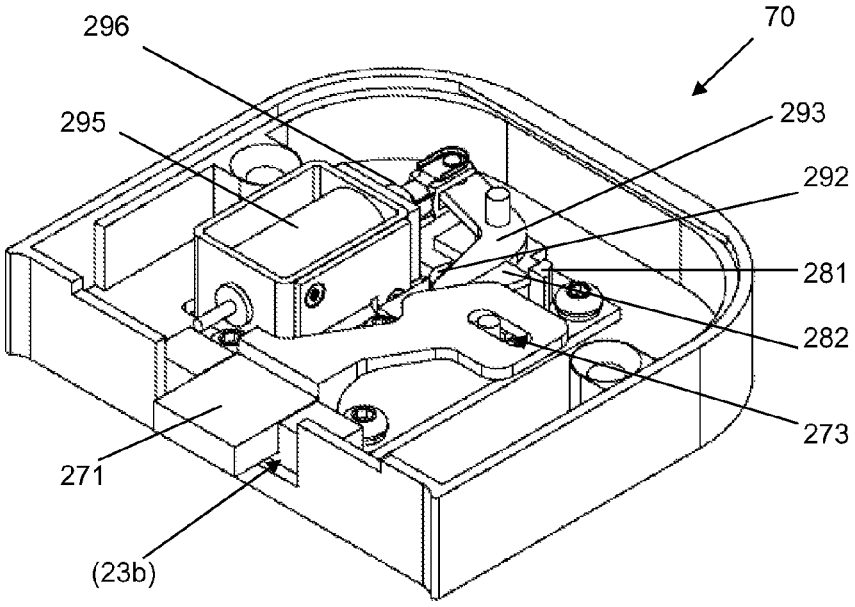
FIGS. 14A and 14B are perspective views inside the second locking module respectively showing the thrown and retracted positions of the locking member.
Figure 15A:
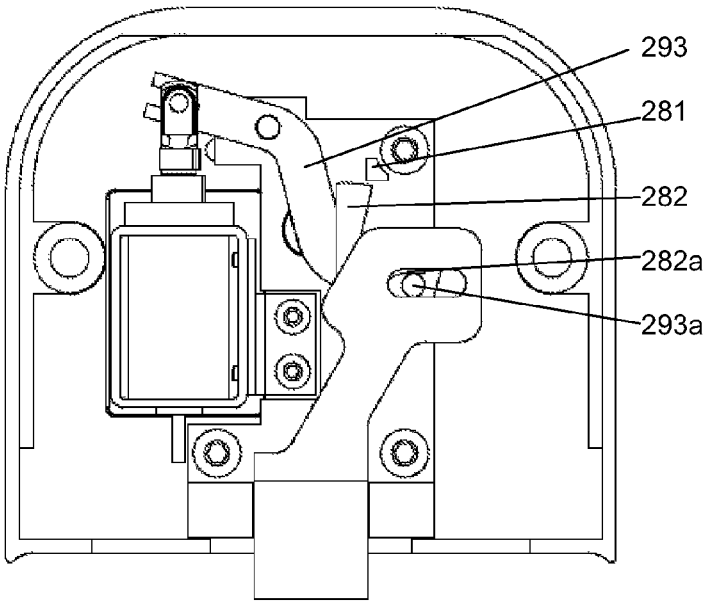
FIGS. 15A and 15B are plan views inside the second locking module of FIGS. 14A and 14B respectively showing the thrown and retracted positions of the locking member.
Figure 14B:
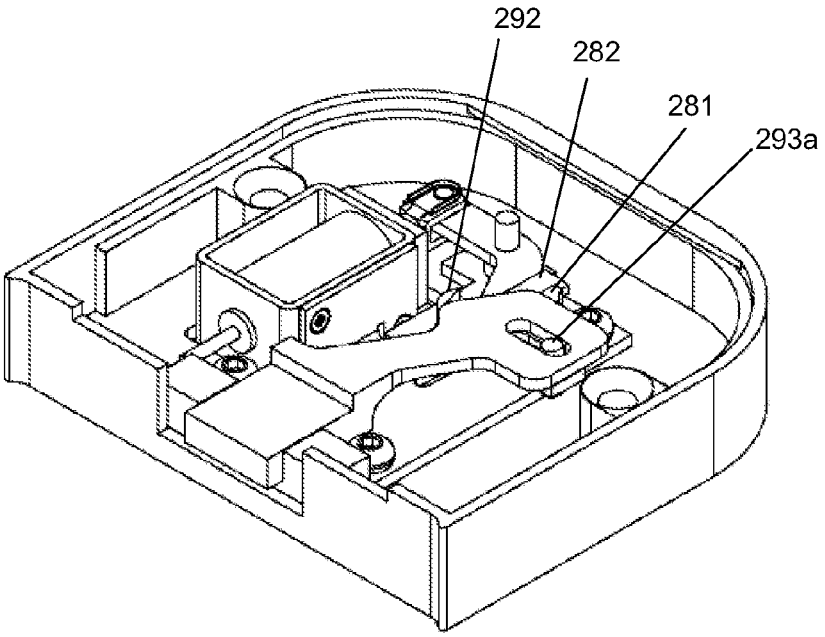
Figure 15B:
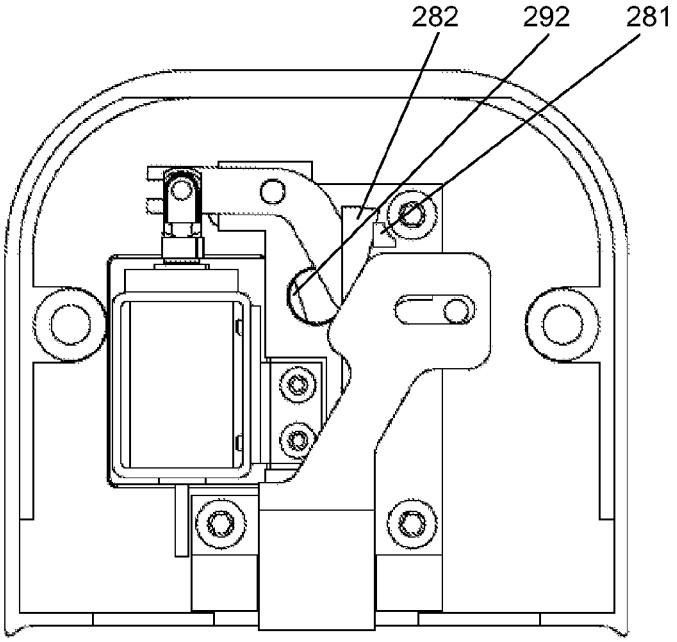

In FIGS. 14A and 15A locking member 271 is shown in the thrown position extending through an aperture. The aperture is coincident with aperture 23*b* in the bolt module 20. The locking member blocks rotation of the outside rotor 50 of the second rotor assembly. In this arrangement movement of the outside rotor is prevented because the outside rotor includes a stopping shoulder and this butts against locking member and cannot be turned. As discussed above for the locking member 161 of the first locking module, various alternatives exist for a locking member interacting with the outside rotor.

The mechanical key of the second locking module acts as an override, for example, in the event that the access control unit fails or there is a loss of power to the unit. The mechanical key may, for example, turn 90 degrees to unlock and then hit a stop forcing the user to rotate the key in the opposite direction to the starting point to remove the key.

The locking member of the second locking module may be sprung so as to lock when the door is closed and any mechanical key is removed. This returns the outside rotors to their thrown or start position. Exit of the room may be achieved by a handle acting as a drive element on an inside rotor.

The second locking module 70 may also comprise additional functionality in the form of a "lock-on" assembly. This assembly may be formed of similar components to the "lock-off" assembly described above in relation to the first locking module 60. The "lock on" feature is used when a user enters the room and wants to prevent other users from also entering the room form the outside. Hence, he can activate the "lock on" function and lock himself in the room. The "lock on" feature is provided by an assembly which acts on the locking member and comprises a pinion gear, a crossbar and a rack of the crossbar. The pinion gear may be driven by a turn knob or key cylinder provided on the inside of the leaf or door. The access control unit and override key cylinder are provided on the outside of the leaf or room. The pinion gear meshes with the rack of the crossbar. The crossbar extends towards the locking member. The locking member 271 includes a notch for receiving the distal end of the crossbar. The notch is provided in the locking member. The notch is in alignment with the crossbar and can receive the distal end of the crossbar when the locking member is in the thrown position extended through the aperture 23*b* in the bolt module. Hence, turning of the pinion gear by the turn knob or key cylinder moves the distal end of the crossbar further towards the notch in the locking member and eventually to engage in the notch of the locking member. Other arrangements for engaging the locking member are possible.

Emergency egress from the room or building was discussed above in relation to the lock system. The emergency egress may be provided even when the "lock on" feature is activated. For example, an emergency exit handle, push bad, panic bar or otherwise may be provided on the inside of the leaf or door and is coupled to the inside rotor of the first or second rotor assembly of the bolt module. The "lock on" feature operates on the second locking module which, as described above, operates on the outer rotor of the first or second rotor assembly. Since the inside rotors operate independently of the outside rotors, actuation of the emergency exit handle will rotate the inside rotors thereby retracting the bolt and allowing the user to exit the room.

Figure 16:
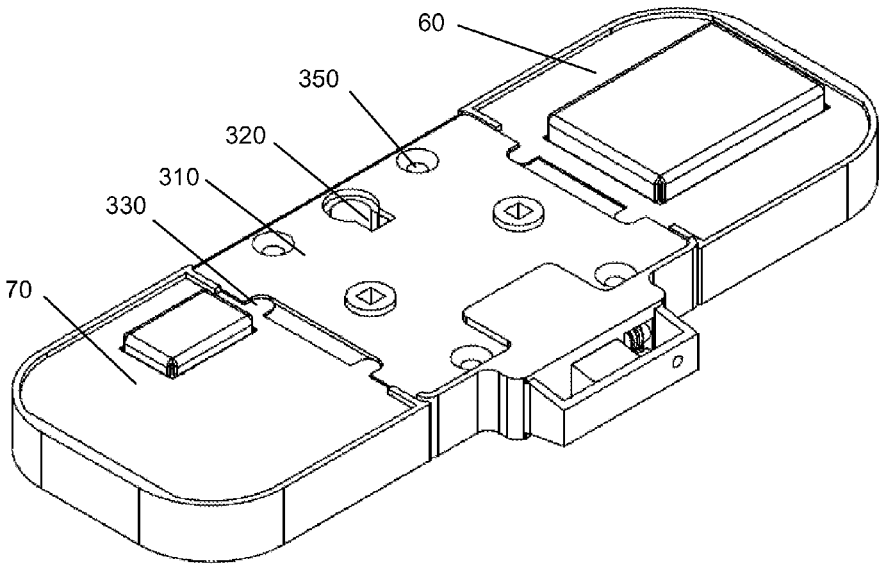
FIG. 16 is a perspective view of the lock system of the present invention, including first locking module, bolt module and second locking module.
Figure 17:
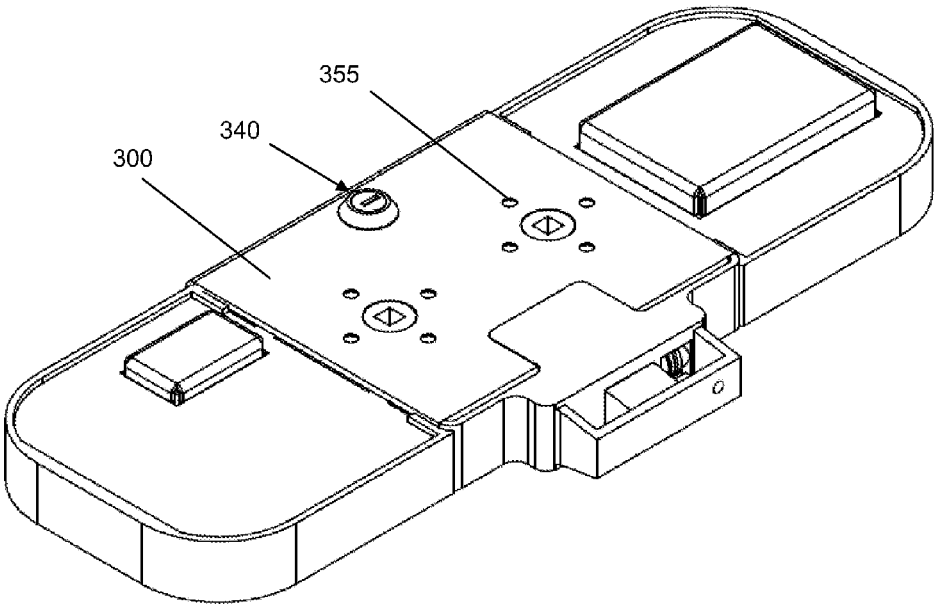
FIG. 17 is perspective view of the lock system of FIG. 16 with a lockable cover fitted.
Figures 18A, 18B:
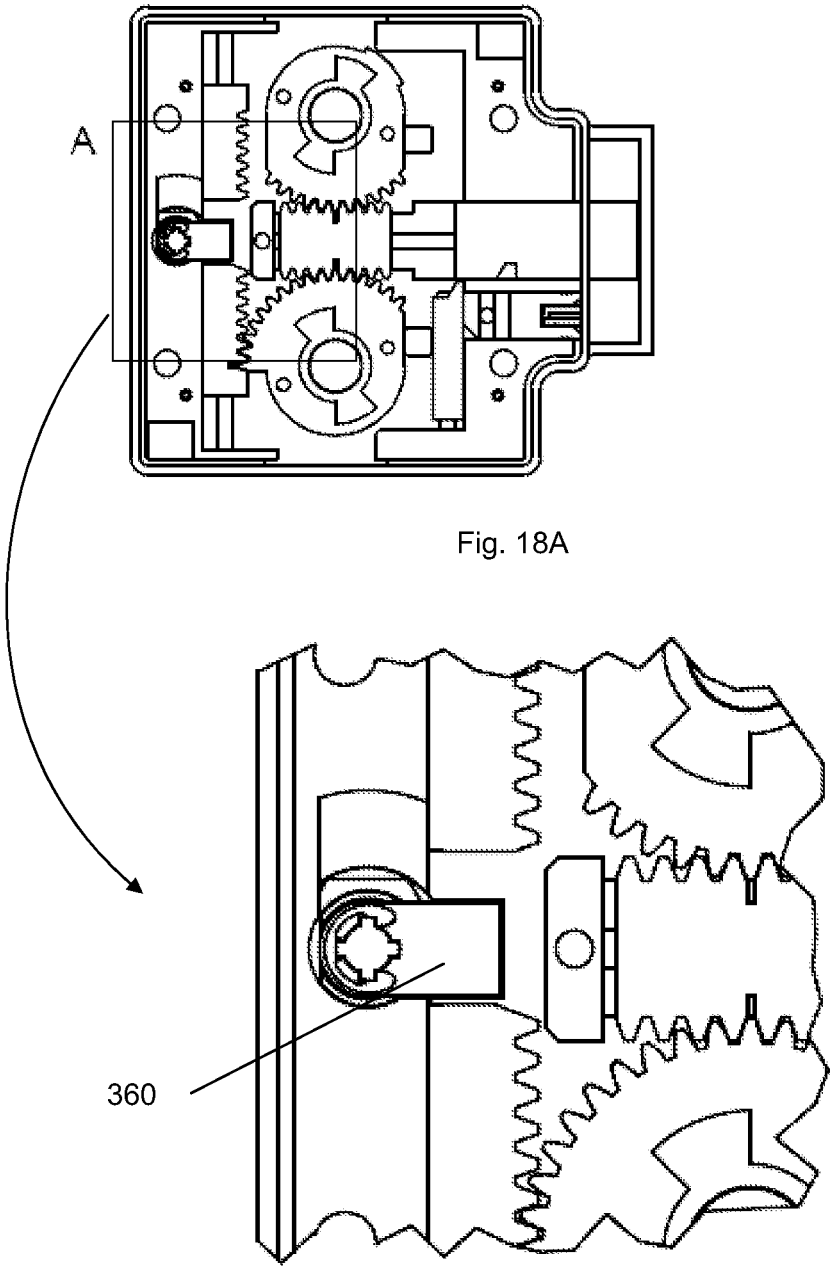
FIGS. 18A and 18B are respectively full and partial plan views of the bolt module showing the cam of the lockable cover in the unlocked position.
Figure 19A:
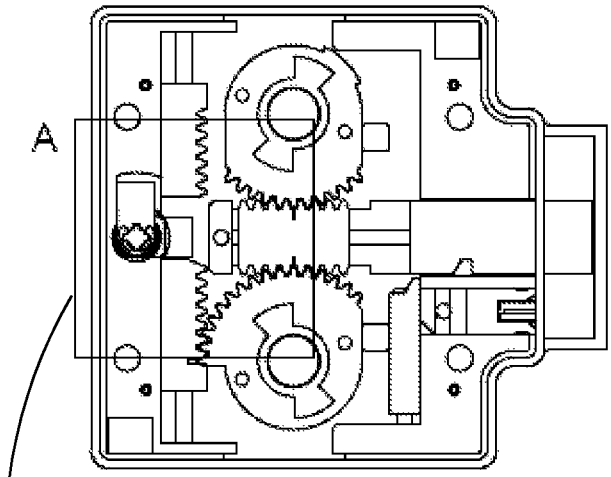
FIGS. 19A and 19B are respectively full and partial plan views of the bolt module showing the cam of the lockable cover in the locked position.
Figure 19B:
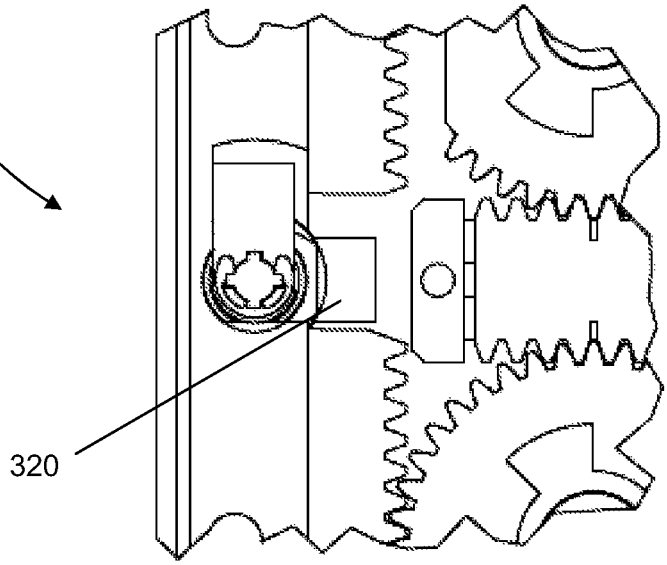
Figure 20:
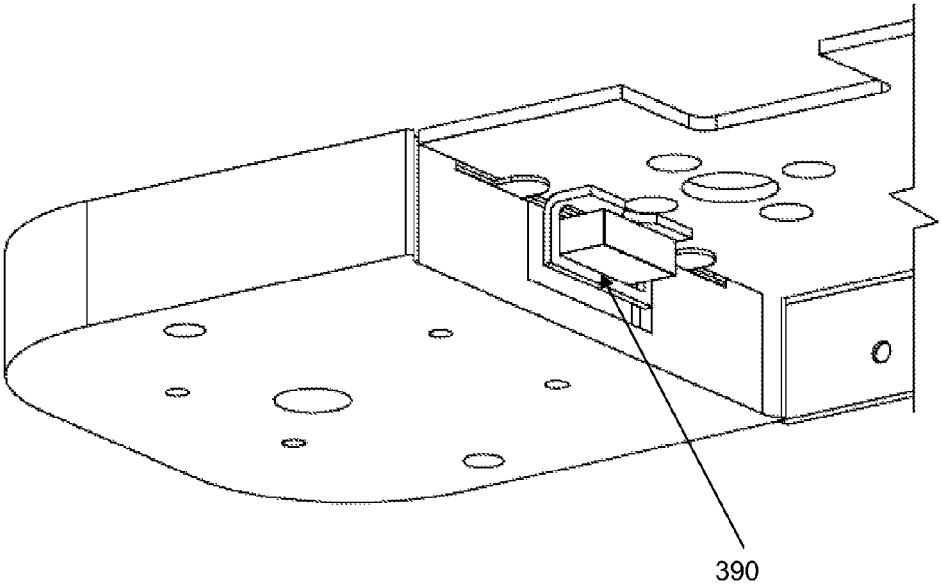
FIG. 20 is a perspective view of the lockable cover with an extension for receiving the locking member of a locking module.

FIG. 17 shows a perspective view of a lockable cover provided for the lock system. FIG. 16 is a similar perspective view of the lock system but without the cover in place. The lockable cover 300 is for covering fixing holes 350 for fixing the bolt module to a leaf or door. The cover itself may also provide fixing holes 355 for receiving fixings for attaching a mount of a drive element thereto. The drive element is for driving an inside rotor. Hence, the cover also comprises one or two apertures for receiving the drive element there through for operating the first or second inside rotor 42, 52.

Figure 21:
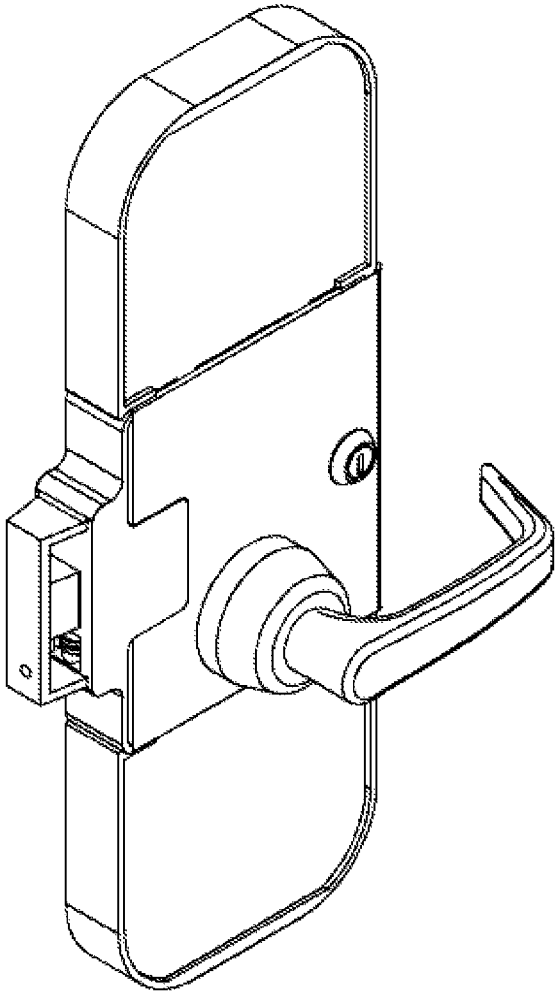
FIG. 21 is perspective view of the lock system with a lockable cover fitted and handle drive element fitted.

FIG. 21 shows the lock system with lockable cover fitted and a handle acting as a drive element. In this configuration the handle operates to drive the lower of the inside rotors for retracting the bolt. First and second locking modules are also shown. The bolt module and locking modules are arranged for mounting of the insider of a door leaf. The outside of the door comprises connections through the modules.

FIGS. 18A, 18B, 19*a* and 19B show the detail of the locking element 360 of the cover viewed from inside the bolt module 20. FIG. 17 shows a key cylinder 340 mounted into the cover. The reverse side of the key cylinder has locking element attached. Upon insertion of the matching key to the key cylinder, part of the key cylinder may be turned to turn the locking element 360. As shown in FIG. 16, housing 310 includes an aperture 320 for receiving the locking element. The key cylinder 340 and locking element 360 are rotated to the unlocked position such that the cover can correctly engage and fit to the housing. In the embodiments shown in the figures the unlocked position is when the locking element is oriented inwards to the centre of the bolt module 20. Aperture 320 in housing receives locking element 360. Turning of the key turns locking element 360 such that it becomes oriented transverse to the aperture 320 and the locking element will no longer pass through aperture, as shown in FIG. 19. Hence, the cover is now locked to housing.

The key cylinder may be further arranged such that the key cannot be removed from the key cylinder if the cover is unlocked.

When the cover is fitted to the housing and before the key is turned the locking element 360 is oriented towards the centre of the bolt module 20. That is the locking element points towards the shoulder part of the bolt 30. In this position, the locking element extends into the path of the bolt preventing its retraction as shown in FIG. 18 (the path appears to be first blocked by anti-thrust member, but this will be moved out of the path when driven by a rotor). The locking element prevents retraction even if the bolt is retracted using drive elements operating on rotors. Once the key of the key cylinder 340 has been turned to the locked position, the locking element is turned 90 degrees out of the path of the bolt 30, as shown in FIG. 19. As a result when the cover is in place the bolt can be retracted only if the key has been turned to the locked position. The locking element may be a cam.

The lockable cover 300 is preferably sized to match the outline of the bolt module as shown in FIGS. 16 and 17. First and/or second locking modules 60 and 70 may include retention members 330 which fit under the lockable cover. The retention members 330 may for example be tabs fitting into recesses in the surface of the housing of the bolt module. When the cover is fitted it covers the retention members. Hence, the locking modules cannot be lifted clear of the bolting module without unlocking the cover.

In another embodiment the cover may extend across the first and second locking modules preventing their removal.

In a second alternative the cover is not flat as shown in the embodiment of FIG. 17, but includes extensions 390 extending at right angles at one or two places. The flat part of the cover is substantially unchanged from the embodiment of FIG. 17, but additionally includes these extensions 390 which fit between bolt module 20 and first and/or second locking module. The extensions comprise an aperture, preferably rectangular through which the locking member 161, 271 of the respective first and second locking modules can pass when they are in the locked position for locking the outside rotors. An extension and aperture may be provided for each locking module. The arrangement prevents removal of the cover when either of the first or second locking modules 60, 70 has its locking member in the locked position. This provides additional security beyond that of the key cylinder of the lockable cover. As a result servicing of the bolt module 20 cannot be performed unless the service engineer has been provided with keys or codes for releasing the locking members of the first and second locking modules, for example the combination lock code and key.

In an alternative arrangement only a single extension is provided to limit access when one of the locking modules has been unlocked instead of requiring both of them to be unlocked.

Figure 22:
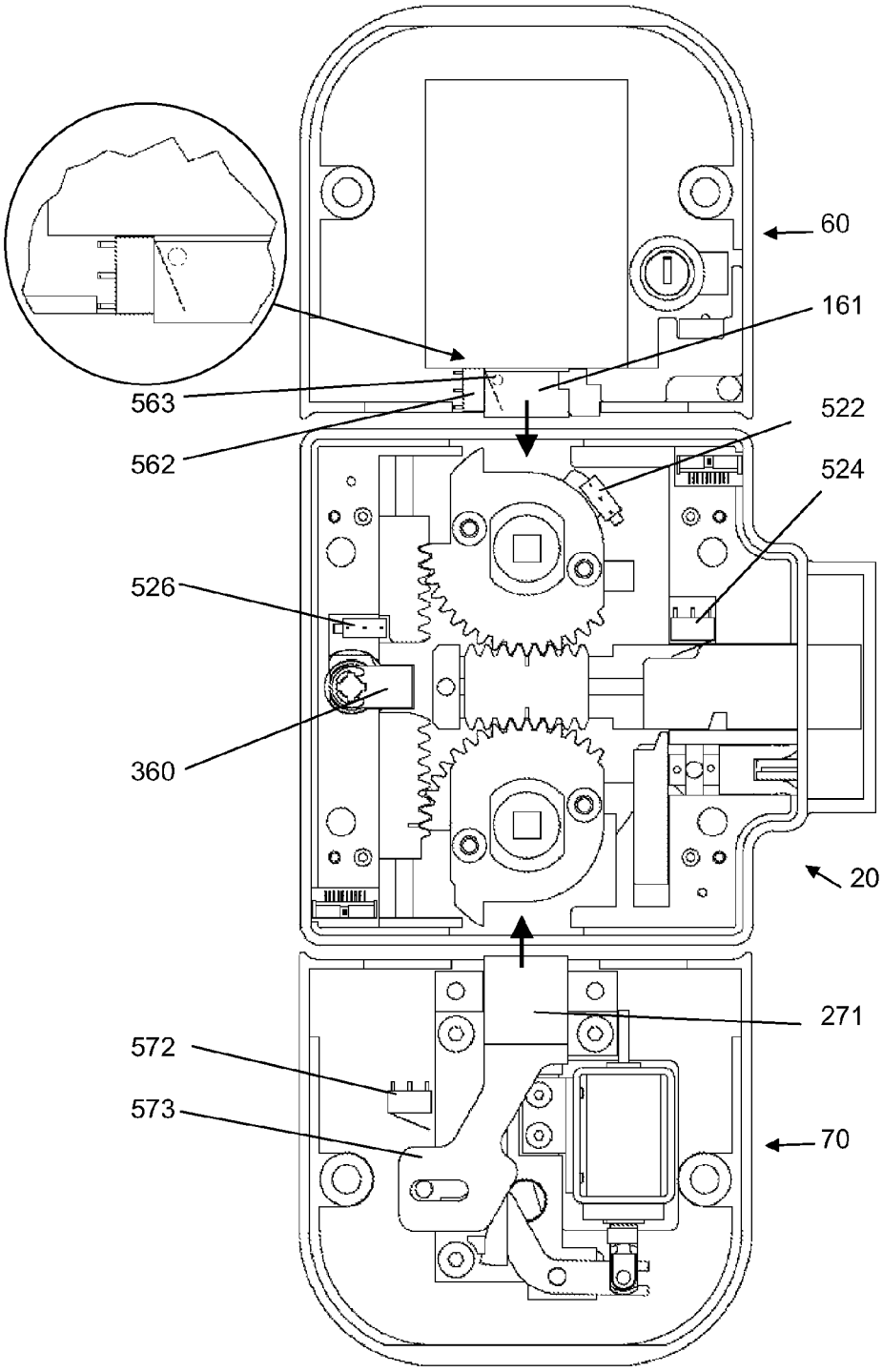
FIG. 22 is a plan view inside the lock system comprising bolt module, first locking module and second locking module, showing microswitches.

FIG. 22 is a plan view showing the inside of the bolt module 20, first locking module 60 and second locking module 70. The inside view is arrived at by removing a part of the housing or cover of the modules. The three modules are approximately arranged in the configuration they would be in use, such as in FIG. 21. For clarity a small gap has been left between the modules so that where one module ends and the other begins can be seen. In practice the modules would be in contact. The figure clearly shows where the locking members 161, 271 of the two locking modules move (indicated by the arrows) to the thrown position, through the apertures in the bolt module and to block movement of the outside rotors.

FIG. 22 also shows a number of microswitches for monitoring the status of the modules. The bolt module may have one, two, three or more microswitches. A first microswitch 524 is provided next to bolt 30 inside of the bolt module. Microswitches typically have an actuator button or lever. In FIG. 22 lever type actuators are shown but button or other types may be used. The lever actuator of microswitch 524 is depressed when the bolt is retracted. The bolt has a recess into which the lever actuator opens when the bolt is thrown. As the bolt is retracted the wider main body of the bolt pushes against the actuator depressing it when the bolt is in the retracted position. Hence, microswitch 524 monitors and can send signals indicating if the bolt is in the thrown or retracted position.

The second microswitch 522 acts on a tab on one of the inside rotors. In FIG. 22 the tab is shown as part of the inside rotor 52. The inside rotor will be driven by drive elements operating from the inside or outside. Rotation of the inside drive element releases the actuator on the microswitch. Microswitch 522 can be used as a monitor in combination with access control unit of second locking module. For example, when exiting from the inside the microswitch 524 can indicate to a controller not to send an alarm as it monitors retraction of the bolt without any pin or swipe card correctly being used to obtain access. This microswitch is therefore known as the "Request to exit" microswitch because it warns the control system of a user exiting from inside, and causes alarms to be cancelled which would normally be initiated when the bolt is retracted without an authorised pin or swipe card being used.

The third microswitch 526 detects tamper of the cover 300. When the cover is secure and locking element or cam 360 has been turned to the locked position, the locking element acts on the microswitch indicating the cover is secure. When the locking element is unlocked or the cover is removed the microswitch is released indicating that the cover is not secure.

First locking module 60 may have a microswitch 562 which monitors the positions of the locking member 161. In the example implementation shown in FIG. 22, the locking member includes a protrusion or pin 563 which acts on the microswitch actuator. The actuator of the microswitch is in the open position when the locking member 161 is retracted. When the locking member is moved to the thrown position to lock a rotor in the bolt module, the pin or protrusion moves the actuator to the closed position.

Second locking module 70 may include microswitch 572 which is acted on by part 573 of locking member 271. The microswitch monitors the position of the locking member 271 and whether it is in the thrown or retracted position. In FIG. 22, the locking member 271 is in the retracted position and the microswitch actuator is in the open position. Movement of the locking member 271 causes part 573 of locking member to push against and close the microswitch 572.

Figure 23:
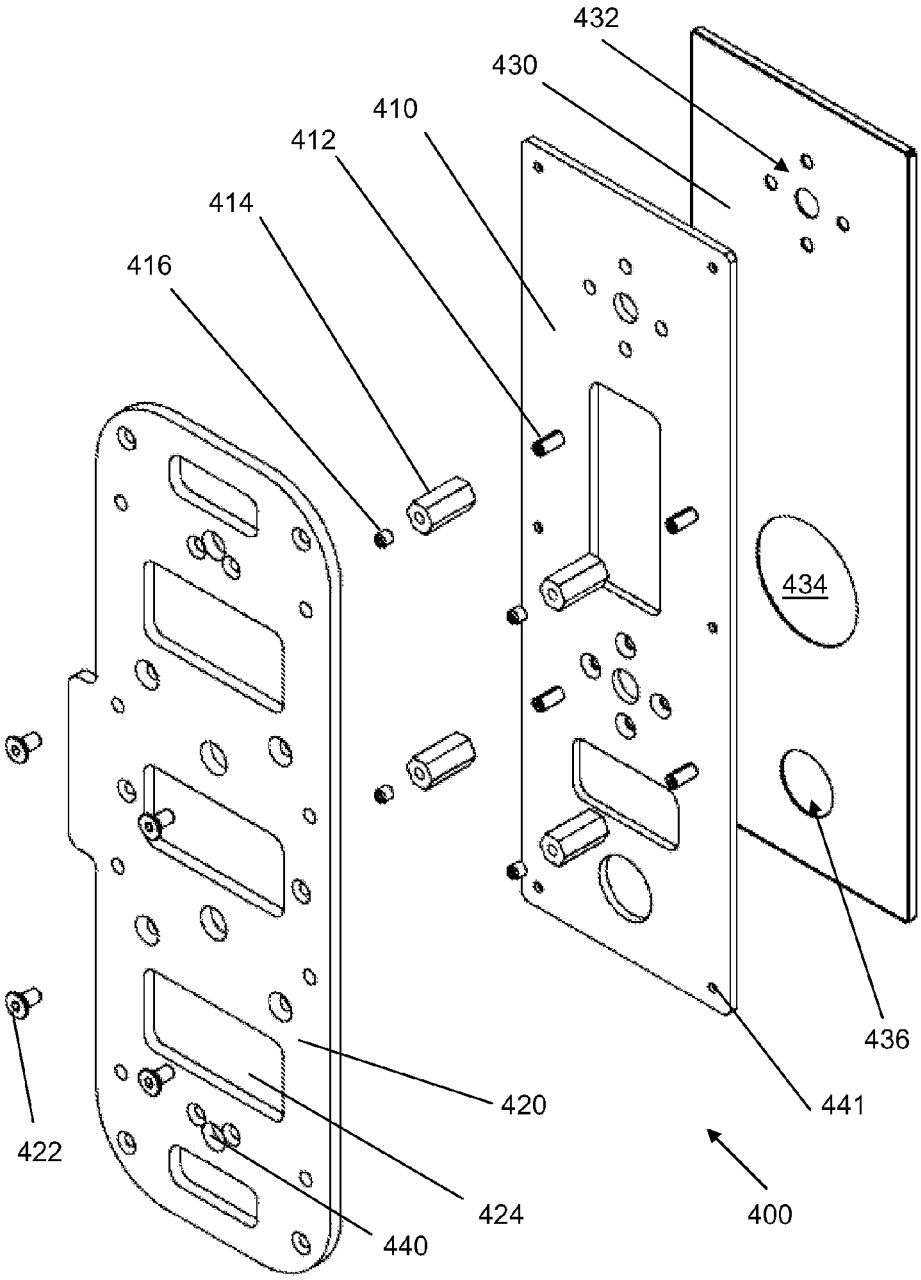
FIG. 23 is a perspective view of sandwich plates for reinforcing a door or leaf according to an embodiment of the invention.

FIGS. 23 and 24 show a sandwich plate arrangement 400 for reinforcing a door or leaf at the location of the lock system or bolt module of the present invention. It is alternatively envisaged that the sandwich plate arrangement could be used for any lock or bolt system where reinforcement of the door or leaf is desired.

Conventionally reinforcing plates or sandwich plates are provided as a pair, having studs for spacing the plates apart to fit against opposing sides of the door or leaf. The studs are welded to one of the plates. These reinforcing plates have two problems. Firstly, the studs provided to fit through the door and space two plates apart are of a fixed length and require cutting to the appropriate length for the thickness of the door. The second problem is that if the studs are cut too short or a fixing, such as a nut or screw, coupling the end of the stud to a plate is tightened too tight, the door may be crushed by bringing the plates too close together.

The sandwich plate arrangement 400 according to the embodiment of FIGS. 23 and 24 comprises two or three plates. First plate 410 and second plate 420 are for fitting to opposing faces of a door or leaf, for example the outside and inside or the door or leaf. First plate may be known as outside plate and second plate may be known as inside plate. Third plate 430 is a cover plate and is optional. In the context of the presently described lock system 10 which includes a bolt module 20 and two locking modules 60, 70, the embodiment of FIG. 23 shows the plates having a size and shape to approximately match the combined footprint of the bolt module and two locking modules. For such a lock system the plates could instead be sized to approximately match any combination of some or all of the bolt module and two locking modules, but preferably at least the bolt module 20. The plates may include weight saving cut-outs, such as 424 in second plate 420.

Figure 24A:
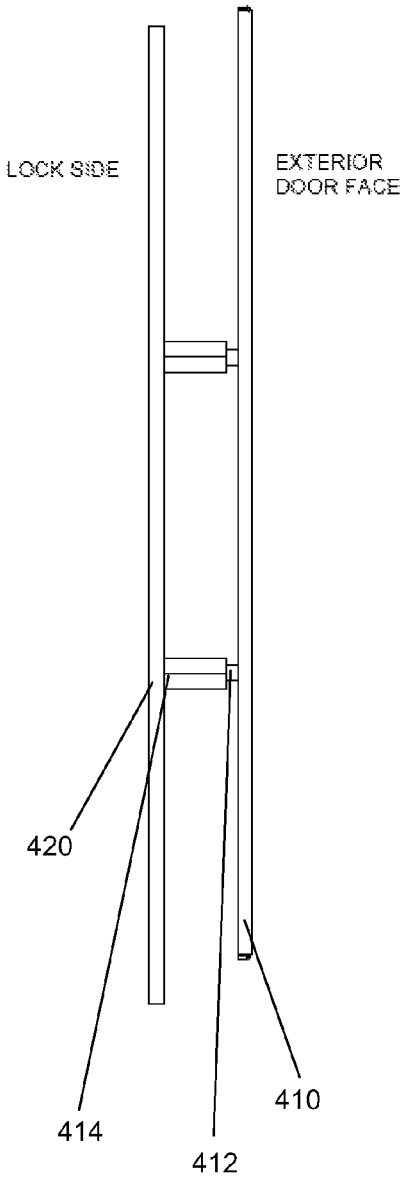
FIGS. 24A and 24B are respectively a side view of sandwich plates and fixing assembly when fitted together as a whole and a partial sectional view through the centre of the fixing assembly.
Figure 24B:
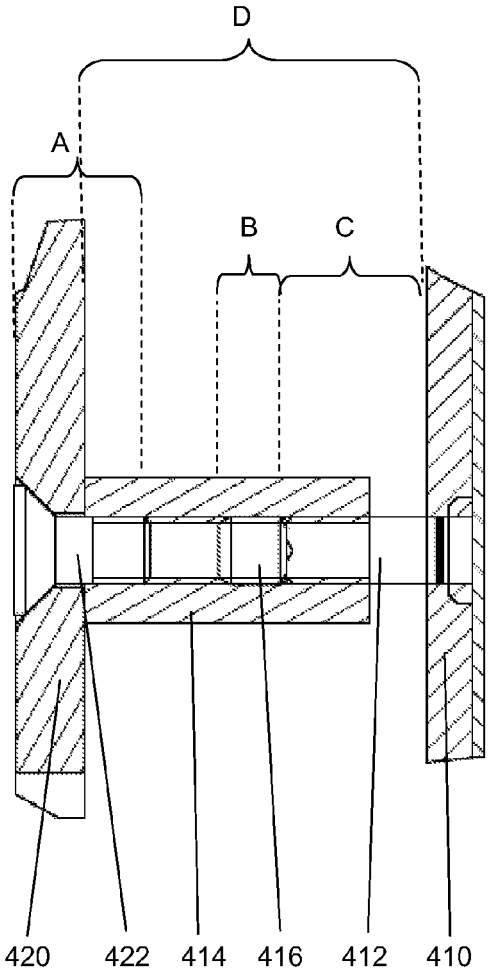

First plate 410 has studs 412 which are preferably formed integral to the plate. Alternatively, they may mount through the plate 410 in such a way as to prevent rotation. The studs have a length to extend partly through the door. In FIG. 24B they are shown as extending to just less than half the thickness of the door, namely to length C. The actual distance they extend will depend on the thickness of the door. Studs 412 are preferably threaded. Pillars 414 each have a through hole along their length which is threaded to match the thread of the studs 412. The pillars are configured to screw on to the studs. The pillars are preferably shaped to be rotated by a spanner or wrench, and as such may be square or hexagonal. When fitting to a door the pillar should be screwed onto the stud such that the length of pillar and stud from the face of the first plate is equal to the thickness of the door, that is, distance D in FIG. 24B. As shown in FIG. 24A the studs butt against the second plate 420. Screws 422 fit through holes in second plate 420 and screw in to the internal thread in the pillar to hold the second plate against the face of the door. Tightening of screws 422 would result in rotation of pillars, which in turn would change the distance between the two plates set by the extent the pillar is screwed on to stud 412. To avoid this, lock screws 416 are provided to lock the position of the pillars and studs together. Lock screws, which may be grub screws (also known as blind set screws), have a thread matching the internal thread of the pillar and fit inside the pillar. The grub screw is tightened to butt against the end of the stud distal to the first plate 410. The tightened grub screw locks the position of the pillar with respect to the stud such that the pillar 414 cannot rotate and the distance D is fixed. The length of grub screw 416 is shown as B in FIG. 24B. Finally, second plate 420 is fixed to the pillars 414 using screw 422 which also has a thread matching that of the internal thread of the pillar. The second plate fixing screws 422 are screwed in to the pillars. The length of screw is shown in FIG. 24B as length A.

As shown in FIG. 24 there is a gap between grub screw 416 (having length B) and second plate fixing screw 422 (having length D). This gap in combination with the ability to move the pillar closer to, or further from (varying length D) the first plate, provides the adjustability to fit different thicknesses of door. By matching the length D to the thickness of the door or leaf crushing of the door is avoided.

Other holes, such as 440 in second plate 420, or 441 in first plate 410, are for fixing the lock system to the plate, door or leaf, or fixing the plate to the door or leaf.

The sandwich plate assembly 400 may also include cover plate 430 for covering the first plate 410. The cover plate may have an external footprint matching the first plate 410. Since first plate may be on the outside of the leaf it is desirable to hide fixings to avoid tamper. In the embodiment shown in FIG. 23, first plate comprises holes for mounting for example locking module and bolt module devices. Hence, for the lock system of the present invention which includes a bolt module 20, first locking module 60 and second locking module 70, hole 434 is provided to receive a drive element or handle for driving a rotor of the bolt module. The handle may be fixed to the first plate 410 using fixing holes. Hole 436 is provided to receive a key cylinder which is the mechanical override of the second locking module 70. Set of holes 432 is used for mounting dial of combination lock of first locking module 60. Of course, other arrangements of holes may be provided to suit other arrangements and functionality of locking modules.

Figure 28:
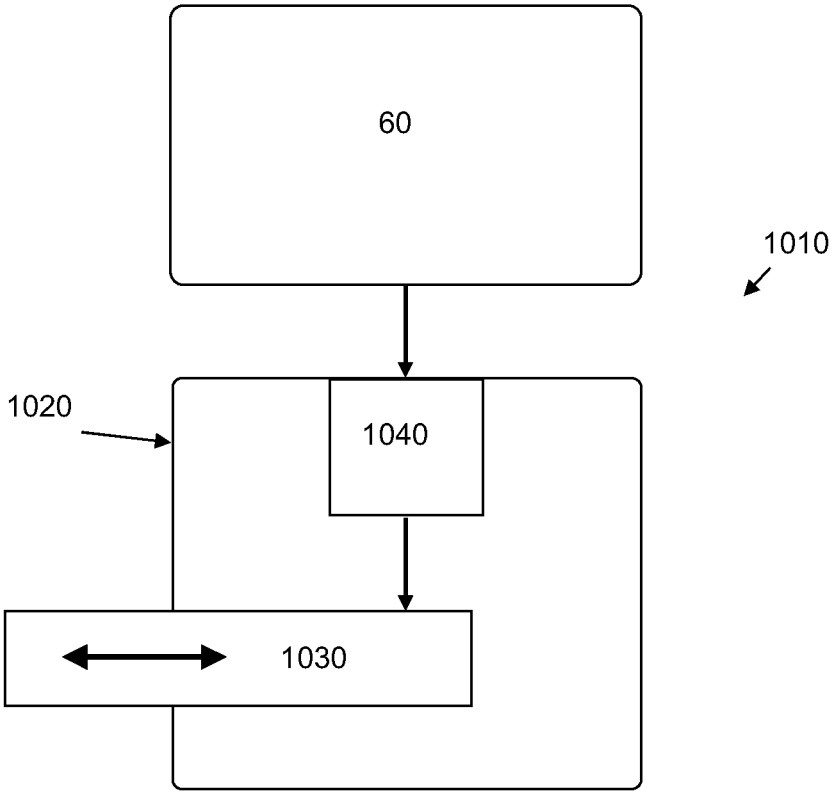
FIG. 28 is a schematic diagram of a single-sided lock system of the present invention.
Figure 29:
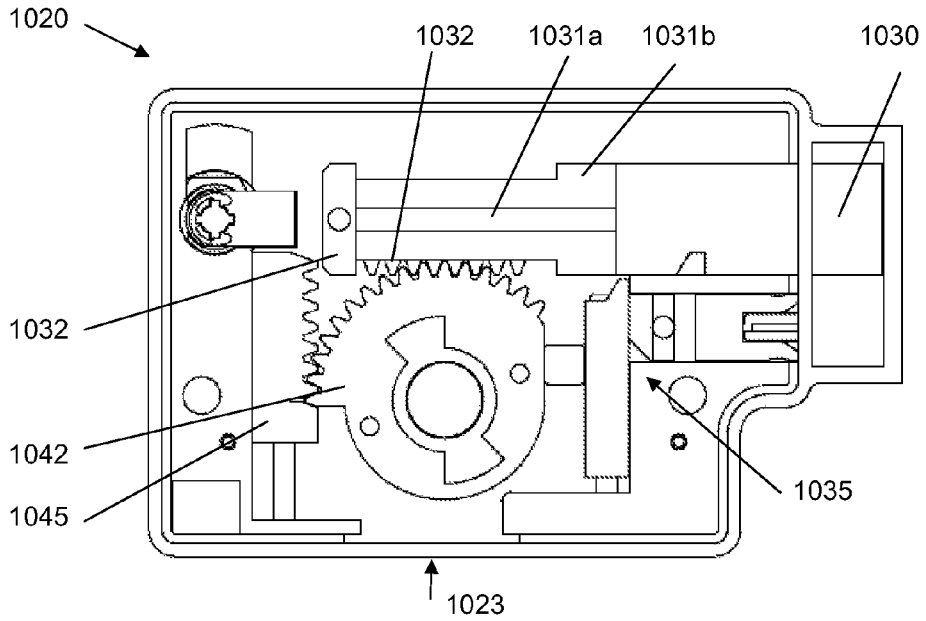
FIG. 29 is a plan view inside the single-sided bolt module showing internal components, with the bolt in the thrown position, and outside rotor and outside slider removed.
Figure 30:
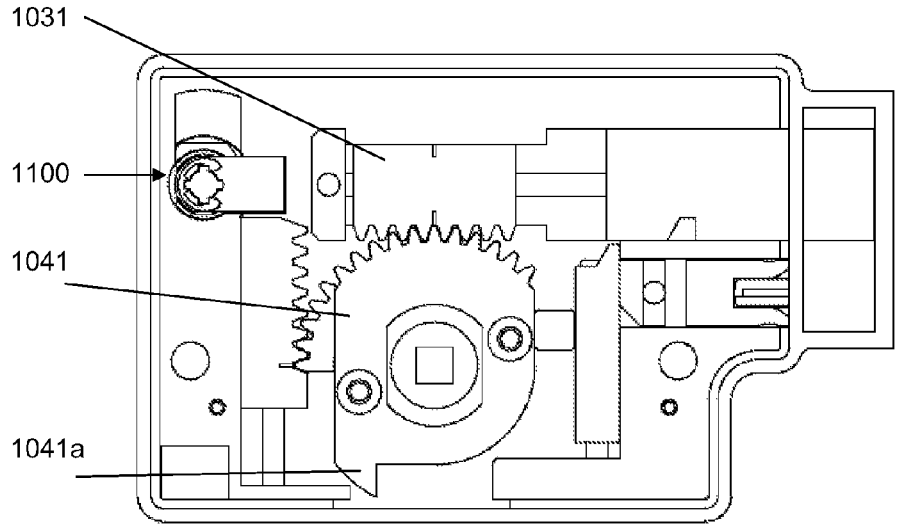
FIG. 30 is a plan view inside the single-sided bolt module showing internal components, with the bolt in the thrown position, with outside rotor and outside slider present.

FIGS. 28-30 show a single sided bolt module which includes some of the functionality of bolt module 20, but is not adapted to be able to select direction of rotation of driving.

FIG. 28 is a schematic diagram showing single sided lock system 1010 comprising single sided bolt module 1020 and a locking module, for example first locking module 60. The bolt module 1020 comprises a bolt 1030 movable between thrown and retracted positions and driven by rotor assembly 1040. The rotor assembly may be at least partly locked by locking module 60. The locking by locking module operates on an outside rotor to prevent access from the outside when the locking module is locked. Exit from the inside may always be possible due to independent drive of the bolt from the inside.

FIG. 29 shows the single sided bolt module with outside rotor and outside slider removed, whereas they are present in FIG. 30. The single sided module is also for use with only a single locking module. This single sided module might be considered an alternative to the device in GB 2289084.

Single sided bolt module 1020 comprises components similar to module 20. The bolt module 1020 comprises a bolt 1030 for driving between thrown and retracted positions. The bolt is driven by rotor assembly which comprises an inside rotor 1041 and outside rotor 1042. The bolt comprises recess 1031*b* in the bolt in which outside slider 1031 is arranged. Movement of the outside slider is guided by guide 1031*a*. On the opposite side of the bolt (the underside as shown in FIGS. 17 and 18) is a further recess in which inside slider 1032 seats. The inside slider is also guided by a corresponding guide. The inside rotor 1042 and outside rotor 1041 rotate on the same axis with lost motion between them. The outside rotor 1041 is adapted to receive a drive element in an aperture in the centre of the rotor. The drive element is for rotating the rotor to retract the bolt. Outside rotor is also arranged to receive a drive element. On turning outside drive element anti-clockwise, outside rotor 1041 is rotated anticlockwise. This rotation drives outside slider in a direction for retracting the bolt (to the left in FIG. 29). The slider moves sideways and abuts the shoulder part 1031*c* of the bolt. Continued driving of the outside rotor 1041 pushes the outside slider against the shoulder part 1031*c* retracting the bolt 1030. When driven by the outside rotor 1041, the inside rotor is also driven. Hence, inside rotor 1042 drives inside slider, which also abuts against a corresponding shoulder part. The bolt is therefore retracted by the action of sliders on both sides of the bolt. If the sliders and bolts are not identical it is possible one of the sliders will abut against shoulder part of the bolt before the other. In such a case either one of the sliders will retract the bolt.

When rotor assembly is driven from the inside, the inside rotor is rotated in the clockwise direction when viewed from the inside (anti-clockwise when viewed as in FIG. 29). The lost motion between the inside rotor and outside rotor means that the outside rotor is not acted on by the inside rotor. The outside rotor 1041 may therefore not move when the inside rotor is turned. When the inside rotor 1042 is turned the inside slider 1032 drives against the shoulder part of bolt 1031*c* thereby retracting the bolt.

The bolt 1030 has a larger recess on the outside side of the bolt, as for the bolt 30 in FIG. 7. The larger recess 1031*b* in FIG. 29 permits the bolt to be retracted without moving the outside slider 1031.

Anti-thrust member 1045 acts to block the path of the bolt 1030 if an external force is applied on the exposed end of the bolt. This operates analogously to the anti-thrust member 45 in FIGS. 3-6, namely the anti-thrust member is moved out of the path of the bolt if either rotor is driven to retract the bolt. The lost-motion between outside and inside rotors is provided in a corresponding manner to FIGS. 3-6. The anti-thrust member 45 also provides bias to inside rotor. This bias biases the inside rotor to throw the bolt. When outside rotor is turned to drive the bolt, the bias will also bias the outside rotor to move it back to the thrown position. Differently to the bolt module of FIGS. 3-6, no bias is directly provided to the outside rotor. Hence, when the inside rotor is turned the outside rotor may also turn due to friction between the rotors. However, it is expected any drive element on the outside will maintain the outside rotor in position. If separate direct bias to the outside rotor is required a bias member could be provided analogously to the anti-thrust member. This would also require additional teeth on the outside rotor if the bias member is provided above the anti-thrust member.

In the same way as for bolt module 20 of FIGS. 3-6 the outside rotor 1042 includes stopping shoulder 1041*a*. As discussed above, the stopping shoulder is one way of arranging the outside rotor to be locked by a locking module, such as may have a locking element for driving into aperture 1023.

As discussed above, inside driving is possible whether or not the locking module acts to lock the part of the rotor assembly, namely the outside rotor. Outside driving is possible only when the locking module is not locked. When locked, rotation of the outside rotor is blocked. The locking module 1060 may be any of the locking modules described above. For example, it may include a combination lock, mechanical key lock, access control unit etc. A preferred embodiment for use on an emergency exit may include a mechanical key for locking from the outside of the door. A handle may be provided on the outside for driving outside rotor. Inside a push pad, panic bar, or touch bar may be provided for egress independent of whether the locking module is locked.

The single sided module can be used on left hand opening and right hand opening doors by inverting the module but the direction of rotation of drive elements cannot be selected. Furthermore, the locking module cannot always be located above the bolt module, because inversion of the bolt module will mean the locking module will also be inverted.

Nevertheless, the lock system is simpler and more compact compared to the lock system 20.

Figure 31A:
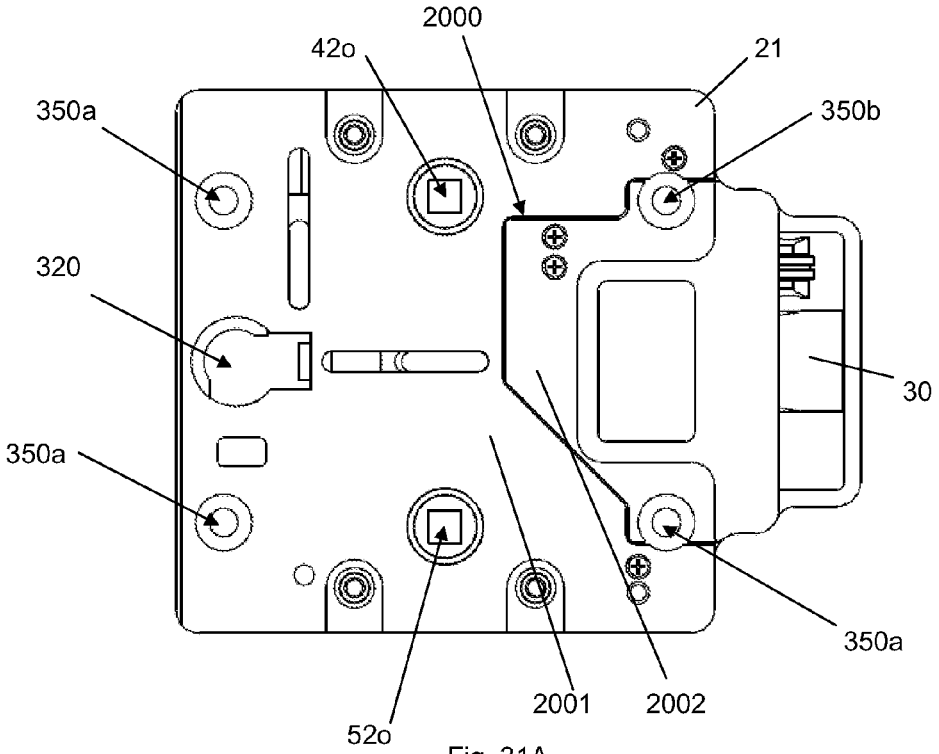
FIGS. 31A and 31B are front and rear plan views of a two-part housing for embodiments of the bolt module.
Figure 31B:
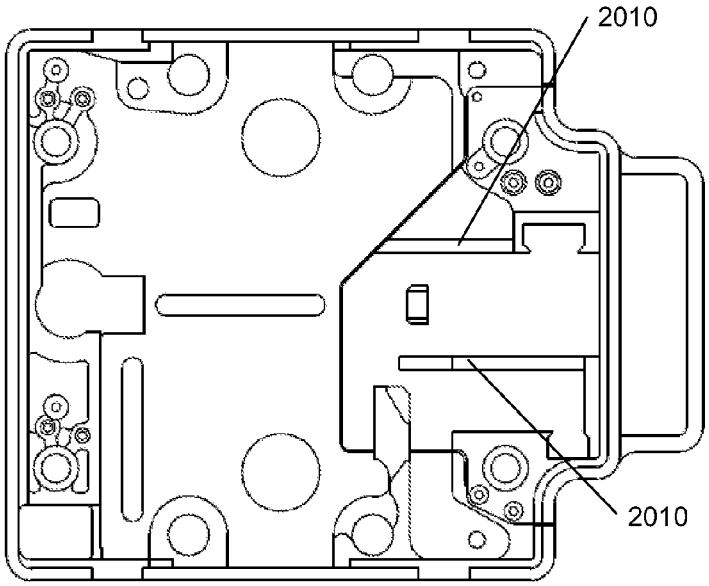

In the bolt module 10, 1010 described above, with reference to FIGS. 3 to 9 and also FIGS. 29 to 30, as well as many of the other figures, there is mentioned a housing 21 which houses, for example, the rotors, rotor assemblies, etc. or other components of the bolt driving assembly etc. FIGS. 31A and 31B show a particular embodiment of the housing 21. In this embodiment the housing is formed of a first portion 2001 and second portion 2002. The first and second portions come together at line 2000. The first and second portions are made of different materials. The line 2000 may represent a join or seam between the two portions or an interface where two separate portions interface or contact each other. The first portion of the housing houses the majority of the bolt driving assembly, that is, the components which accept a drive element for driving the bolt between thrown and retracted positions. For example, in embodiments the one or two rotor assemblies may be housed in the first portion. The first and second portions together complete the housing enclosing the inner workings of the bolt module and holding the bolt, for example, forming an outer shell of the bolt module. The second portion of the housing houses at least part of the bolt and constrains the position and/or movement of the bolt. The second portion is arranged to maintain the bolt in position, even in the absence of the first portion of the housing. This is achieved by the first portion having one or more guides 2010 which constrain the movement of the bolt for movement between thrown and retracted positions only. In one embodiment, at least one of the guides is a wall neighbouring a sliding side of the bolt. In other embodiments the guides may comprise one or more posts constraining the bolt movement. A combination of posts and walls may be used. The guides constrain opposing sides of the bolt. The second housing may also comprise a plate part which constrains a front or rear face of the bolt. The side of the housing has an aperture through which the bolt extends at least in the thrown position. The aperture may be an open or closed aperture in, for example, a faceplate of the bolt module. The aperture constrains the bolt such that it in combination with the guides only sliding motion between thrown and retracted positions of the bolt is permitted.

FIG. 31 shows four holes 350*a*, 350*b* for mounting the housing to a leaf or door. The two holes 350*a* are formed in the first portion of the housing. The holes 350*b* are formed in the second portion of the housing. Although FIG. 31 shows two holes formed in each portion other numbers of holes are possible. It is also possible to have mounting holes only in the second portion. In such a case the first portion would couple or fasten to the second portion.

The housing shown in FIG. 31 corresponds to the housing shown in FIGS. 16 and 17 and is configured for receiving a cover lockable to the housing. Aperture 320 is that shaped for receiving locking element 310 of cover. The face of the housing shown in the plan view of FIG. 31A is the face located away from the leaf. Holes 350*a* and 350*b* are configured for receiving screw, bolts or other fasteners there through for mounting to the door or leaf. These mounting holes and fasteners may be hidden by cover 310. In FIG. 31A spindle apertures 42*o* and 52*o* of first and second rotor assemblies are shown. A base-plate may be fitted between housing 21 and door or leaf to complete the enclosure of the bolt assembly.

The first portion and second portion are made of different materials. The second portion is made of a material having a higher melting point than that of the first portion. For example, the second portion may be made of steel, stainless steel or other steel-based material, whereas the first portion may be formed of aluminium or other aluminium-based material. Aluminium is light weight compared to steel or stainless steel and it is therefore desirable to make the bolt module of aluminium. In particular, for bolt modules and lock systems described herein the bolt module and lock system are complex and may be relatively heavy. Hence, the need for lightweight materials is increased. However, in the event of an extreme fire temperatures in excess of 700° C. may be reached. Aluminium has a relatively low melting point at around 660° C. whereas that of stainless steel is much higher at over 1000° C. such as 1300-1450° C. Hence, in an extreme fire the first portion could melt and the second portion would remain intact. The bolt should also be made of the steel material such as that used for the second portion. Although the lock would not be fully functional because of the loss of the first portion of the housing, the second portion would continue to hold the bolt. Hence, for the case of a door or leaf secured closed by the thrown bolt of the bolt module, the door would be retained closed because the bolt would remain in position.

Although the housing shown in FIG. 31 is similar to those shown in FIGS. 3 to 9 relating to the twin drive bolt module having first and second rotor assemblies, the housing is applicable to any of the bolt modules described herein. Furthermore, such a two part housing arrangement may be applicable to bolt and lock systems generally.

The person skilled in the art will readily appreciate that various modifications and alterations may be made to the above described lock system, bolt module, locking module and lockable cover. The modifications may be made without departing from the scope of the appended claims. For example, the rotors and sliders are shown as gears driving racks, but may be instead arranged with levers or belts. Furthermore, the rotors and locking modules are described as being located on opposing sides of the bolt. This may not always be necessary. Variations in the actual shapes of the parts such as the rotors, sliders, bolt, and modules may also be made without diverging from the general scope of the present invention.

What is claimed is:

1. A lock system for securing a leaf having an inside and an outside, the lock system comprising:

a bolt module including:

a bolt moveable between a thrown position and a retracted position to secure the leaf; and first and second rotor assemblies disposed on opposing sides of the bolt, each rotor assembly being capable of accepting both inside and outside drive elements each for driving the bolt between the thrown and retracted positions from the respective side, wherein at least one rotor assembly comprises an inside rotor capable of accepting an inside drive element and an outside rotor capable of accepting an outside drive element, the inside rotor and outside rotor arranged for rotation about a common axis and having lost-motion there between, and first and second locking modules, each locking module being operable to lock at least a part of the respective first or second rotor assembly such that the locking module prevents at least the outside drive element from driving the bolt.

2. The lock system of claim 1, wherein at least another part of the respective first or second rotor assembly is configured so as not to be lockable by the first and/or second locking module so as to allow the inside drive element to drive the bolt.

3. The lock system of claim 1, wherein the rotor assemblies are arranged such that to retract the bolt, a drive element accepted by the first rotor assembly is rotated in an opposite direction to a drive element accepted by the second rotor assembly.

4. The lock system of claim 1, wherein the bolt module further comprises an anti-thrust assembly arranged to block driving back of the bolt from the thrown position by an external force on the bolt, the anti-thrust assembly arranged to be released for retraction of the bolt upon driving by a rotor assembly.

5. The lock system of claim 1, wherein each locking module is disposed on an opposite side of the corresponding rotor assembly from the bolt.

6. The lock system of claim 1, wherein the outside rotor is arranged to be locked by the first or second locking module, and the inside rotor is arranged to retract the bolt when driven by the inside drive element independently of whether the outside rotor is locked.

7. The lock system of claim 1, wherein the bolt is arranged such that the drive of the inside rotor by the inside drive element drives the outside rotor and together the inside rotor and outside rotor retract the bolt.

8. The lock system of claim 1, wherein the bolt is arranged to be driven by the rotor assemblies by action of a slider on the bolt, the slider arranged to transmit motion of a rotor assembly to the bolt and including lost motion between the bolt and slider such that the rotor assembly is not driven when an external force is applied to the bolt.

9. The lock system of claim 8, wherein the slider is an outside slider arranged to be operated on by at least one outside rotor, the bolt module further comprising an inside slider arranged to transmit motion of an inside rotor to retract the bolt including lost motion between the bolt and inside slider such that the inside rotor is not driven when an external force is applied on the bolt, the sliders arranged to have lost motion with the bolt such that on driving the bolt by an inside rotor, the outside slider and outside rotors are not moved.

10. The lock system of claim 1, wherein the outside rotor has a stopping shoulder arranged to be operated on by the locking module to stop rotation of the outside rotor when the locking module locks said at least a part of the respective rotor assembly.

11. The lock system of claim 8, wherein the slider transmits rotation from one rotor assembly to the other such when the first rotor assembly is rotated to retract the bolt the direction of rotation is opposite to the direction of rotation of the second rotor assembly for retracting the bolt.

12. The lock system of claim 1, wherein the bolt module further comprises an anti-thrust assembly arranged to block driving back of the bolt from the thrown position by an external force on the bolt, the anti-thrust assembly arranged to be released for retraction of the bolt upon driving by a rotor assembly, and the anti-thrust member is biased to the drive the bolt to the thrown position.

13. The lock system of claim 12, wherein the anti-thrust member operates on an outside rotor.

14. The lock system of claim 12, further comprising a bias member operating on an inside rotor to bias the bolt to the thrown position.

15. The lock system of claim 14, wherein the bias member provides an anti-thrust to prevent driving back of the bolt when an external force is applied on the bolt.

16. The lock system of claim 1, wherein the bolt module further comprises a bolt restraint latch and trigger, the bolt restraint latch configured to operate on the bolt and engage with the bolt when the bolt is moved to the retracted position so as to restrain the bolt in that position, and the trigger extending from the bolt module and arranged such that on striking of the trigger the trigger pushes against the bolt restraint latch releasing the bolt.

17. The lock system of claim 16, wherein the amount the trigger extends from the bolt module is adjustable.

18. The lock system of claim 17, wherein the trigger comprises a trigger finger and a latch pusher, the latch pusher coupled to the trigger finger by a threaded rod screwed into a mating thread in the trigger finger, the distance between the latch pusher and trigger finger being set by turning the screw so as to adjust amount the trigger extends from the bolt module.

19. The lock system of claim 1, the bolt module comprising a housing formed of a first housing portion and a second housing portion, at least the second housing portion having holes or fixings for fixing to a leaf, wherein the first housing portion houses the first and second rotor assemblies, the second housing portion houses the bolt, the second housing portion having one or more guides to constrain the direction of movement of the bolt to movement between thrown and retracted positions, and the first and second housing portions are of different materials.

20. The lock system of claim 19, wherein the guides of the second housing support the bolt to retain the thrown bolt in the absence of the first housing portion, when fitted to a leaf.

21. The lock system of claim 19, wherein the second housing portion has an aperture through which the bolt extends when securing the leaf.

22. The lock system of claim 19, wherein the material of the second housing portion has a higher melting point than the material of the first housing portion.

23. The lock system of claim 22, wherein the material of the second housing portion is stainless steel, steel or a steel-based material.

24. The lock system of claim 22, wherein the material of the first housing portion is aluminum, or an aluminum-based material.

25. A bolt module comprising:

a bolt moveable between a thrown position and a retracted position for securing a leaf; and first and second rotor assemblies disposed on opposing sides of the bolt, each rotor assembly being capable of accepting drive elements each for driving the bolt between the thrown and retracted positions, wherein at least one rotor assembly comprises an inside rotor capable of accepting an inside drive element and an outside rotor capable of accepting an outside drive element, the inside rotor and outside rotor arranged for rotation about a common axis and having lost-motion there between, wherein at least one rotor assembly comprises an inside rotor capable of accepting an inside drive element and an outside rotor capable of accepting an outside drive element, the inside rotor and outside rotor arranged for driving the bolt, the outside rotor adapted to be capable of being locked, the inside rotor and outside rotor arranged for rotation about a common axis and having lost-motion there between such that the inside rotor is arranged to retract the bolt when driven by the inside drive element independently of whether the outside rotor is locked.

26. The bolt module of claim 25, wherein the inside rotor is arranged such that the drive of the inside rotor by the inside drive element drives the outside rotor and together the inside rotor and outside rotor retract the bolt.

27. A lock system for securing a leaf having an inside and an outside, the lock system comprising:

a bolt module including:

a bolt moveable between a thrown position and a retracted position; and a rotor assembly for driving the bolt, the rotor assembly capable of accepting both inside and outside drive elements each for driving the bolt between thrown and retracted positions from the respective side, wherein the rotor assembly comprises inside and outside rotors respectively capable of accepting inside and outside drive elements each for driving the bolt from the respective side, the inside and outside rotor elements having lost-motion there between such that the inside rotor can be driven to retract the bolt when the outside rotor is locked by the locking module, and a locking module operable to lock at least a part of the rotor assembly such that the locking module prevents at least the outside drive element from driving the bolt.

28. The lock system of claim 27, wherein the rotor assembly comprises a cam, the locking module having a locking member arranged such that when in the locked position it interferes with the cam preventing the outside drive element from driving the bolt.

29. The lock system of claim 28, wherein the cam of the rotor assembly comprises a stopping shoulder, the stopping shoulder arranged such that rotation of the cam is blocked by the locking member of the locking module thereby preventing the outside drive element from driving the bolt.

30. A lock system for securing a leaf having an inside and an outside, the lock system comprising:

a bolt module including:

a bolt moveable between a thrown position and a retracted position to secure the leaf; and first and second rotor assemblies disposed on opposing sides of the bolt, each rotor assembly being capable of accepting both inside and outside drive elements each for driving the bolt between the thrown and retracted positions from the respective side, wherein the bolt module further comprises an anti-thrust assembly arranged to block driving back of the bolt from the thrown position by an external force on the bolt, the anti-thrust assembly arranged to be released for retraction of the bolt upon driving by a rotor assembly, and first and second locking modules, each locking module being operable to lock at least a part of the respective first or second rotor assembly such that the locking module prevents at least the outside drive element from driving the bolt.

31. The lock system of claim 30, wherein the anti-thrust member is biased to drive the bolt to the thrown position.

* * * * *